US010026304B2

(12) United States Patent
Taylor et al.

(10) Patent No.: US 10,026,304 B2
(45) Date of Patent: Jul. 17, 2018

(54) CALIBRATING AN ENVIRONMENTAL MONITORING DEVICE

(71) Applicant: LEEO, INC., Palo Alto, CA (US)

(72) Inventors: Kyle Taylor, Sunnyvale, CA (US); Lucas D. Ivers, Mountain View, CA (US); Jane L. Nguyen, Sunnyvale, CA (US); Laura Marshall, Newark, CA (US); Venu K. Tangirala, Fremont, CA (US); Andrew G. Stevens, Palo Alto, CA (US)

(73) Assignee: Leeo, Inc., San Mateo, CA (US)

( * ) Notice: Subject to any disclaimer, the term of this patent is extended or adjusted under 35 U.S.C. 154(b) by 185 days.

(21) Appl. No.: 14/887,223

(22) Filed: Oct. 19, 2015

(65) Prior Publication Data

US 2016/0110994 A1 Apr. 21, 2016

Related U.S. Application Data

(60) Provisional application No. 62/066,309, filed on Oct. 20, 2014.

(51) Int. Cl.

| | |
|---|---|
| ***G08B 29/20*** | (2006.01) |
| ***G08B 29/22*** | (2006.01) |
| ***G08B 1/08*** | (2006.01) |

(52) U.S. Cl.

CPC ..... *G08B 29/22* (2013.01); *G08B 1/08* (2013.01)

(58) Field of Classification Search

None

See application file for complete search history.

(56) References Cited

U.S. PATENT DOCUMENTS

| | | | |
|---|---|---|---|
| 900,595 | A | 10/1908 | Sanders |
| 988,665 | A | 4/1911 | Ripson |

(Continued)

FOREIGN PATENT DOCUMENTS

| | | | |
|---|---|---|---|
| EP | 1500955 | A1 | 1/2005 |
| GB | 2454731 | A | 5/2009 |

(Continued)

OTHER PUBLICATIONS

Frear, Wm, "Making Soil and Crops Pay More", Crop Book Department of Virginia Carolina Chemical Co., (1918).

(Continued)

*Primary Examiner* — Quan-Zhen Wang
*Assistant Examiner* — Chico A Foxx
(74) *Attorney, Agent, or Firm* — Ashley Sloat; Steven Stupp; Aurora Consulting LLC

(57) ABSTRACT

A computer that facilitates calibration of an environmental monitoring device is described. In particular, the computer may interact with an electronic device of a user of the environmental monitoring device to calibrate the environmental monitoring device. During the calibration, the computer provides user-interface information associated with a user interface that allows the user to select to select to monitor sound corresponding to an alarm output by a legacy device (such as a smoke detector) that is in an external environment that includes the environmental monitoring device. When the user selects to monitor a legacy device, the computer provides an instruction to the electronic device for the user to activate the legacy device. Then, the computer receives legacy-device information from the environmental monitoring device, specifying whether the legacy device was detected, a type of legacy device identified based on the monitored sound and/or a location of the legacy device.

18 Claims, 20 Drawing Sheets

(56) References Cited

U.S. PATENT DOCUMENTS 3,030,806 A 4/1962 Merlin
3,499,664 A 3/1970 Burns
3,722,501 A 3/1973 Derouineau
3,767,933 A 10/1973 Bogue
3,895,638 A 7/1975 Ito
4,093,867 A 6/1978 Shah
4,286,470 A 9/1981 Lynnworth
4,418,333 A 11/1983 Schwarzbach
4,450,436 A 5/1984 Massa
4,772,126 A 9/1988 Allemand
4,812,827 A 3/1989 Scripps
4,829,283 A 5/1989 Spang
4,837,656 A * 6/1989 Barnes ..... B21D 43/025 340/652
4,896,039 A 1/1990 Fraden
4,896,136 A 1/1990 Hotovy
4,984,380 A 1/1991 Anderson
5,003,486 A 3/1991 Hendel
5,045,833 A 9/1991 Smith
5,068,715 A 11/1991 Wade
5,156,203 A 10/1992 Funakoshi
5,159,315 A 10/1992 Schultz
5,185,531 A 2/1993 Wynn
5,192,271 A 3/1993 Kalb
5,307,051 A 4/1994 Sedlmayr
5,426,501 A 6/1995 Hokanson
5,478,256 A 12/1995 Koganemaru
5,492,482 A 2/1996 Lockman
5,493,618 A 2/1996 Stevens
5,532,660 A 7/1996 Smith
5,578,995 A 11/1996 Bryant
5,623,197 A 4/1997 Roseman
5,646,591 A 7/1997 Issa
5,675,070 A 10/1997 Gelperin
5,745,670 A 4/1998 Linde
5,801,297 A 9/1998 Mifsud
5,855,494 A 1/1999 Blaszcyk et al.
5,905,436 A 5/1999 Dwight et al.
5,924,486 A 7/1999 Ehlers
5,936,613 A 8/1999 Jaeger
5,977,913 A * 11/1999 Christ ..... G01C 21/206 340/524
6,023,223 A 2/2000 Baxter
6,023,233 A 2/2000 Craven
6,074,089 A 6/2000 Hollander
6,077,107 A 6/2000 Hetherington
6,084,572 A 7/2000 Yaniger
6,158,868 A 12/2000 Chien
6,216,956 B1 4/2001 Ehlers
6,234,642 B1 5/2001 Bokamper
6,257,758 B1 7/2001 Culbertson
6,408,704 B1 6/2002 Willeke
6,415,205 B1 7/2002 Myron
6,428,334 B1 8/2002 Skarie
6,442,999 B1 9/2002 Baumoel
6,492,907 B1 12/2002 Mccracken
6,542,234 B1 4/2003 Ulrich
6,554,439 B1 4/2003 Teicher
6,615,147 B1 9/2003 Jonker
6,672,129 B1 1/2004 Frederickson
6,677,573 B1 1/2004 Nakata
6,741,177 B2 5/2004 Ballantyne
6,753,776 B2 6/2004 Drinkard
6,753,786 B1 6/2004 Apperson
6,759,763 B2 7/2004 Barton
6,762,686 B1 7/2004 Tabe
6,772,052 B1 8/2004 Amundsen
6,828,909 B2 12/2004 Script
6,873,725 B2 3/2005 Xu
6,892,317 B1 5/2005 Sampath et al.
6,950,017 B2 9/2005 Smith
6,981,943 B2 1/2006 Noguchi
6,991,029 B2 1/2006 Orfield
7,038,398 B1 5/2006 Lys
7,049,968 B2 5/2006 Fitzgerald
7,089,780 B2 8/2006 Sunshine
7,098,782 B1 8/2006 Peckham
7,116,213 B2 10/2006 Thiesen
7,119,789 B1 10/2006 Shaw
7,155,317 B1 12/2006 Tran
7,166,796 B2 1/2007 Nicoloau
7,166,937 B2 1/2007 Wilson
7,227,652 B2 6/2007 Cronch
7,257,397 B2 8/2007 Shamoon
7,264,377 B2 9/2007 Cooper
7,287,738 B2 10/2007 Pitlor
7,304,129 B2 12/2007 Saffell
7,304,259 B2 12/2007 Schwarz
7,337,078 B2 2/2008 Bond
RE40,437 E 7/2008 Rosen
7,400,594 B2 7/2008 Pereira
7,405,524 B2 7/2008 Null
7,420,293 B2 9/2008 Donnelly
7,424,624 B2 9/2008 Espinoza-Ibarra
7,438,446 B1 10/2008 Mccann
7,492,273 B2 2/2009 Sharpe
7,502,199 B2 3/2009 Hori
7,515,041 B2 4/2009 Eisold
7,520,607 B2 4/2009 Casper
7,522,036 B1 4/2009 Preuss
7,629,880 B2 * 12/2009 Stilp ..... G08B 1/08 340/506
7,649,472 B1 1/2010 Paterno
7,673,525 B2 3/2010 Huang
7,685,861 B2 3/2010 Lynch
7,710,824 B1 5/2010 Katzer et al.
7,714,536 B1 5/2010 Silberg
7,764,180 B2 7/2010 Huang
7,784,293 B2 8/2010 Violand
7,786,879 B2 8/2010 Lax
7,818,184 B2 10/2010 Penny
7,825,546 B2 11/2010 Li
7,828,463 B1 11/2010 Willis
7,874,695 B2 1/2011 Jensen
7,905,154 B2 3/2011 Jones
7,908,211 B1 3/2011 Chen
7,952,475 B2 5/2011 Ivanov
7,963,177 B2 6/2011 Gysling
7,992,332 B2 8/2011 Lowenthal
7,994,928 B2 8/2011 Richmond
8,018,327 B2 9/2011 Nelson
8,051,312 B2 11/2011 Foley
8,060,018 B2 11/2011 Davis
8,097,984 B2 1/2012 Baarman
8,113,069 B2 2/2012 Settles
8,125,194 B2 2/2012 Nethken
8,155,012 B2 4/2012 Austermann
8,170,722 B1 5/2012 Elberbaum
8,224,576 B2 7/2012 Jensen
8,242,640 B2 8/2012 Lee
8,255,090 B2 8/2012 Frader-Thompson
8,289,135 B2 10/2012 Griffin
8,301,271 B2 10/2012 Lee
8,314,590 B2 11/2012 Chen
8,335,936 B2 12/2012 Jonsson
8,350,406 B2 1/2013 Byrne et al.
8,360,406 B2 1/2013 Byrne
8,369,135 B1 2/2013 Mani
8,451,132 B1 5/2013 Van Vleet
8,463,452 B2 6/2013 Masters
8,466,626 B2 6/2013 Null
8,467,987 B1 * 6/2013 Davidson ..... H04W 24/06 455/408
8,475,367 B1 7/2013 Yuen
8,483,112 B2 7/2013 Keshavarzian
8,489,437 B1 7/2013 Dlott
8,493,618 B2 7/2013 Ishii
8,523,758 B1 9/2013 Kirby
8,543,247 B2 9/2013 Boss
8,564,403 B2 10/2013 Landau-Holdsworth
8,583,843 B2 11/2013 Rosso
8,605,091 B2 12/2013 Bradbury
8,610,587 B2 12/2013 Tropper
8,636,271 B2 1/2014 Check

(56) References Cited

U.S. PATENT DOCUMENTS 8,639,391 B1 1/2014 Alberth
8,660,582 B2 2/2014 Chen
8,683,236 B2 3/2014 Ukita
8,730,004 B2 5/2014 Elfstrom et al.
8,805,386 B2 8/2014 Ch
8,823,529 B2 9/2014 Reed
8,897,804 B2 11/2014 Couch
8,910,298 B2 12/2014 Gettings
8,917,186 B1 * 12/2014 Grant ..... G08B 29/126 340/692
8,973,019 B1 3/2015 Lunev
9,008,588 B2 * 4/2015 Aydin ..... H04W 24/06 455/501
9,064,394 B1 6/2015 Trundle
2001/0007800 A1 7/2001 Skarie
2002/0011947 A1 1/2002 Stolarczyk
2002/0037026 A1 3/2002 Sato
2002/0050932 A1 5/2002 Rhoades
2002/0086019 A1 5/2002 Amonou
2002/0069076 A1 6/2002 Faris
2002/0073138 A1 6/2002 Gilbert
2002/0095260 A1 7/2002 Huyn
2002/0095269 A1 7/2002 Natalini
2002/0097546 A1 7/2002 Weinberger
2002/0152037 A1 10/2002 Sunshine
2002/0170367 A1 11/2002 Lieber
2003/0028270 A1 2/2003 Peterson
2003/0059185 A1 3/2003 Russell
2003/0074092 A1 4/2003 Carrabis
2003/0194904 A1 10/2003 Rupert et al.
2003/0221118 A1 11/2003 Walker
2003/0227220 A1 12/2003 Biskup
2003/0227389 A1 12/2003 McGreal
2003/0231495 A1 12/2003 Searfoss
2004/0015572 A1 1/2004 Kang
2004/0025604 A1 2/2004 Call
2004/0030531 A1 2/2004 Miller
2004/0069046 A1 4/2004 Sunshine
2004/0075566 A1 4/2004 Stepanik
2004/0147038 A1 7/2004 Lewis
2004/0158193 A1 8/2004 Bui
2004/0210155 A1 10/2004 Takemura
2004/0215981 A1 10/2004 Ricciardi
2005/0045784 A1 3/2005 Pitlor
2005/0073405 A1 4/2005 Spoltore
2005/0111213 A1 5/2005 Smith
2005/0131705 A1 * 6/2005 Gandhi ..... G08B 1/08 704/273
2005/0136972 A1 6/2005 Smith
2005/0148890 A1 7/2005 Hastings
2005/0154494 A1 7/2005 Ahmed
2005/0229452 A1 10/2005 Shimasaki
2005/0276051 A1 12/2005 Caudle
2005/0289378 A1 12/2005 Vorenkamp
2006/0004492 A1 1/2006 Terlson
2006/0017579 A1 * 1/2006 Albert ..... G04G 13/021 340/628
2006/0119954 A1 6/2006 Casper
2006/0173580 A1 8/2006 Desrochers
2006/0176167 A1 * 8/2006 Dohrmann ..... G08B 25/001 340/506
2006/0236325 A1 10/2006 Rao
2006/0238757 A1 10/2006 Silcott
2006/0250236 A1 11/2006 Ackley
2006/0250260 A1 * 11/2006 Albert ..... G06F 19/3418 340/628
2006/0272417 A1 12/2006 Zanker
2006/0287783 A1 12/2006 Walker
2007/0038334 A1 2/2007 Chou
2007/0061393 A1 3/2007 Moore
2007/0109121 A1 5/2007 Cohen
2007/0132558 A1 6/2007 Rowe
2007/0138307 A1 6/2007 Khoo
2007/0155349 A1 7/2007 Nelson
2007/0168088 A1 7/2007 Ewing
2007/0173978 A1 7/2007 Fein
2007/0182963 A1 8/2007 Wright
2007/0219650 A1 9/2007 Wang et al.
2007/0225868 A1 9/2007 Terlson
2007/0241615 A1 10/2007 Goodrich
2007/0268687 A1 11/2007 Scannell
2007/0276548 A1 11/2007 Uzunovic
2007/0278285 A1 12/2007 Ehrensvaerd
2008/0024089 A1 1/2008 Meng
2008/0065247 A1 * 3/2008 Igoe ..... H04L 12/2809 700/94
2008/0096620 A1 4/2008 Lee
2008/0097809 A1 4/2008 Stroman
2008/0106424 A1 5/2008 Bouse
2008/0120296 A1 5/2008 Kariathungal
2008/0123332 A1 5/2008 Searfoss
2008/0143525 A1 6/2008 Woodbury
2008/0155429 A1 6/2008 Frank et al.
2008/0173817 A1 7/2008 Goldstein
2008/0204258 A1 8/2008 Dayton
2008/0211683 A1 9/2008 Curt
2008/0221714 A1 9/2008 Schoettle
2008/0279287 A1 11/2008 Asahina
2008/0291036 A1 11/2008 Richmond
2008/0303678 A1 12/2008 Mccredy
2009/0012633 A1 1/2009 Liu
2009/0021375 A1 * 1/2009 Stagg ..... G06K 7/109 340/572.1
2009/0031786 A1 2/2009 Takeuchi
2009/0054799 A1 2/2009 Vrtis
2009/0065596 A1 3/2009 Seem
2009/0066513 A1 3/2009 Kondo
2009/0073694 A1 3/2009 Scannell, Jr.
2009/0096620 A1 4/2009 Kuo
2009/0105558 A1 4/2009 Riley-Doucet
2009/0140898 A1 6/2009 Ceballos
2009/0141898 A1 6/2009 Huang
2009/0154148 A1 6/2009 Meyer
2009/0157839 A1 6/2009 Diederichs
2009/0193578 A1 8/2009 Jang
2009/0195382 A1 8/2009 Hall
2009/0225480 A1 9/2009 Baxter
2009/0237262 A1 * 9/2009 Smith ..... A61B 5/14532 340/635
2009/0243597 A1 10/2009 Spenik
2009/0271013 A1 10/2009 Chen
2009/0278868 A1 11/2009 Nakahira
2009/0290156 A1 11/2009 Popescu
2009/0298957 A1 12/2009 Gauthier
2009/0303031 A1 12/2009 Strohallen
2010/0008286 A1 1/2010 Abedi
2010/0025449 A1 2/2010 Longobardi
2010/0033329 A1 2/2010 Davis
2010/0070619 A1 3/2010 Chaganti
2010/0071008 A1 3/2010 Hu
2010/0076615 A1 3/2010 Daniel
2010/0090822 A1 4/2010 Benson
2010/0101264 A1 4/2010 Nishino
2010/0115259 A1 * 5/2010 Elsila ..... G06F 1/3203 713/100
2010/0145543 A1 6/2010 Middlemiss
2010/0159998 A1 6/2010 Luke
2010/0161778 A1 6/2010 Guinard
2010/0164711 A1 7/2010 Arms
2010/0164742 A1 7/2010 Anderson
2010/0182201 A1 7/2010 Graczyk
2010/0191551 A1 7/2010 Drance
2010/0201536 A1 8/2010 Robertson
2010/0214090 A1 8/2010 Sartini
2010/0214417 A1 8/2010 Gennari
2010/0228819 A1 9/2010 Wei
2010/0235004 A1 9/2010 Thind
2010/0249955 A1 9/2010 Sitton
2010/0259396 A1 * 10/2010 Watabe ..... G01N 29/032 340/577
2010/0264871 A1 10/2010 Matouka
2010/0274367 A1 10/2010 Kaufman

(56) References Cited

U.S. PATENT DOCUMENTS

2010/0277315 A1* 11/2010 Cohn ..... G08B 29/02 340/540
2010/0277316 A1 11/2010 Schlangen
2010/0279675 A1 11/2010 Slack
2010/0296685 A1 11/2010 Carle
2010/0298742 A1 11/2010 Perlman
2010/0298957 A1 11/2010 Sanchez Rocha
2010/0306033 A1 12/2010 Oved
2010/0313748 A1 12/2010 Schluter
2010/0318236 A1 12/2010 Kilborn
2010/0323594 A1 12/2010 Sun
2011/0003587 A1 1/2011 Belz
2011/0007491 A1 1/2011 Robinson
2011/0025499 A1 2/2011 Hoy
2011/0027626 A1 2/2011 Lattin
2011/0031897 A1* 2/2011 Henig ..... H05B 37/0254 315/297
2011/0046792 A1 2/2011 Imes
2011/0074596 A1 3/2011 Frohlick
2011/0082599 A1 4/2011 Shinde
2011/0093281 A1 4/2011 Plummer
2011/0095801 A1 4/2011 Bjerregaard et al.
2011/0108724 A1 5/2011 Ewing
2011/0185198 A1 7/2011 Ukita
2011/0187542 A1 8/2011 Dittmer
2011/0202193 A1 8/2011 Craig
2011/0216453 A1 9/2011 Haines
2011/0245988 A1 10/2011 Ingels
2011/0260851 A1 10/2011 Richman
2011/0270458 A1 11/2011 Liu
2011/0273283 A1 11/2011 Schmuttor
2011/0275960 A1 11/2011 Westerink
2011/0292446 A1 12/2011 Kojima
2011/0313582 A1 12/2011 Van Megen
2011/0316355 A1 12/2011 Gruber
2012/0004871 A1 1/2012 Tsao
2012/0022886 A1 1/2012 Ohnemus
2012/0023555 A1 1/2012 Putterman
2012/0025221 A1 2/2012 Sakumoto
2012/0041917 A1 2/2012 Newton
2012/0051714 A1 3/2012 Reimnitz
2012/0071008 A1 3/2012 Sessford
2012/0072755 A1 3/2012 Jun
2012/0082180 A1 4/2012 Edwardson
2012/0086402 A1 4/2012 Carder
2012/0086825 A1 4/2012 Yost
2012/0087211 A1 4/2012 Lee et al.
2012/0095610 A1 4/2012 Chapel
2012/0098439 A1 4/2012 Recker et al.
2012/0105201 A1 5/2012 Sanders
2012/0109398 A1 5/2012 Bhakta
2012/0119714 A1 5/2012 Jitaru
2012/0124354 A1 5/2012 Batwara
2012/0130544 A1 5/2012 Mohan
2012/0154126 A1 6/2012 Cohn
2012/0161969 A1 6/2012 Husen
2012/0166642 A1 6/2012 Saint Clair et al.
2012/0172027 A1 7/2012 Partheesh
2012/0194082 A1 8/2012 Huang
2012/0197196 A1 8/2012 Halbert
2012/0206050 A1 8/2012 Spero
2012/0209634 A1 8/2012 Ling
2012/0229248 A1 9/2012 Parshionikar
2012/0229278 A1 9/2012 Roosli
2012/0258800 A1 10/2012 Mikhailov
2012/0265361 A1 10/2012 Billingsley
2012/0268136 A1 10/2012 Lee
2012/0271471 A1 10/2012 Lee
2012/0278101 A1 11/2012 Homchowdhury
2012/0280809 A1 11/2012 Glenn
2012/0283860 A1 11/2012 Ho
2012/0288124 A1 11/2012 Fejzo
2012/0303554 A1 11/2012 Osann
2012/0310703 A1 12/2012 Cavalcanti
2012/0314344 A1 12/2012 Lam
2012/0316661 A1 12/2012 Rahman
2012/0319593 A1 12/2012 Jou
2012/0319838 A1 12/2012 Ly
2012/0325023 A1 12/2012 Calio
2013/0006436 A1 1/2013 Masters
2013/0013967 A1 1/2013 Gokhale et al.
2013/0019320 A1 1/2013 Ericsson
2013/0021720 A1 1/2013 Ty et al.
2013/0024211 A1 1/2013 Monteforte
2013/0035599 A1 2/2013 De Bruijn
2013/0035992 A1 2/2013 Silverman
2013/0038470 A1 2/2013 Niemeyer
2013/0049466 A1 2/2013 Adams
2013/0049607 A1 2/2013 Urata
2013/0051543 A1 2/2013 McDysan et al.
2013/0054750 A1 2/2013 Rossmann
2013/0057384 A1 3/2013 Morris
2013/0058116 A1 3/2013 Galbas
2013/0076506 A1* 3/2013 Smith ..... G08B 29/22 340/514
2013/0076507 A1* 3/2013 Petricoin, Jr. ..... H04N 7/14 340/539.11
2013/0082817 A1 4/2013 Gruenbacher
2013/0083805 A1 4/2013 Lu
2013/0085609 A1 4/2013 Barker
2013/0085615 A1 4/2013 Barker
2013/0107041 A1 5/2013 Norem
2013/0119891 A1 5/2013 Herremans
2013/0135214 A1 5/2013 Li
2013/0141233 A1 6/2013 Jacobs et al.
2013/0144644 A1 6/2013 Simpson
2013/0154823 A1* 6/2013 Ostrer ..... G08B 21/18 340/539.1
2013/0162821 A1 6/2013 Park
2013/0166089 A1 6/2013 Craig
2013/0174646 A1 7/2013 Martin
2013/0175132 A1 7/2013 Battlogg
2013/0184880 A1 7/2013 Mcmahon
2013/0200254 A1 8/2013 Johnson
2013/0201033 A1 8/2013 Cohn
2013/0234625 A1 9/2013 Kondo
2013/0238153 A1 9/2013 Warwick
2013/0252638 A1 9/2013 Yang
2013/0264889 A1 10/2013 Quittek
2013/0271015 A1 10/2013 Peng
2013/0275148 A1 10/2013 Attaluri
2013/0276144 A1 10/2013 Hansen
2013/0289919 A1 10/2013 Wilson
2013/0297330 A1* 11/2013 Kamen ..... G06F 19/323 705/2
2013/0335220 A1* 12/2013 Scherrer ..... G08B 21/10 340/540
2013/0338839 A1 12/2013 Rogers
2013/0339766 A1 12/2013 Chen
2013/0346229 A1 12/2013 Martin
2014/0006506 A1 1/2014 Frei
2014/0025221 A1 1/2014 Chapel
2014/0028097 A1 1/2014 Augur
2014/0032003 A1 1/2014 Chapel
2014/0035749 A1 2/2014 Reed
2014/0046599 A1 2/2014 Smith
2014/0052300 A1 2/2014 Matsuoka et al.
2014/0069131 A1 3/2014 Masui
2014/0070959 A1 3/2014 Bhargava et al.
2014/0075220 A1 3/2014 Song
2014/0075496 A1 3/2014 Prakash
2014/0092765 A1 4/2014 Agarwal
2014/0098445 A1 4/2014 Hooper
2014/0099941 A1 4/2014 Ji
2014/0100700 A1 4/2014 Matsumoto
2014/0101346 A1 4/2014 Naaman
2014/0118144 A1 5/2014 Amis
2014/0122140 A1 5/2014 Rijnders et al.
2014/0141725 A1 5/2014 Jesme
2014/0143149 A1 5/2014 Aissi
2014/0143569 A1 5/2014 Banerjee
2014/0156084 A1 6/2014 Rahman
2014/0185646 A1 7/2014 Mowry
2014/0187162 A1 7/2014 Mei

(56) References Cited

U.S. PATENT DOCUMENTS

| | | | | |
|---|---|---|---|---|
| 2014/0188286 | A1 | 7/2014 | Hunka | |
| 2014/0218194 | A1* | 8/2014 | Gruber | G08B 19/005 340/540 |
| 2014/0218391 | A1* | 8/2014 | McConnell | G06Q 10/107 345/619 |
| 2014/0233186 | A1 | 8/2014 | Savelli | |
| 2014/0236372 | A1 | 8/2014 | Ewing | |
| 2014/0253326 | A1 | 9/2014 | Cho | |
| 2014/0257572 | A1 | 9/2014 | Mohan | |
| 2014/0274147 | A1 | 9/2014 | Kennedy | |
| 2014/0277869 | A1 | 9/2014 | King | |
| 2014/0281544 | A1 | 9/2014 | Paczkowski | |
| 2014/0283144 | A1 | 9/2014 | Gettings | |
| 2014/0292514 | A1 | 10/2014 | Glenn | |
| 2014/0340227 | A1 | 11/2014 | Reed | |
| 2014/0364089 | A1 | 12/2014 | Leinhart | |
| 2014/0365611 | A1 | 12/2014 | Praveenkumar | |
| 2015/0021465 | A1 | 1/2015 | Gettings | |
| 2015/0049191 | A1 | 2/2015 | Scalisi | |
| 2015/0065161 | A1 | 3/2015 | Ganesh | |
| 2015/0072663 | A1 | 3/2015 | Chande | |
| 2015/0102927 | A1* | 4/2015 | Johnson | H04W 4/008 340/539.14 |
| 2015/0179038 | A1 | 6/2015 | Daniel | |
| 2015/0195100 | A1 | 7/2015 | Imes | |
| 2015/0206421 | A1* | 7/2015 | Moffa | G08B 29/043 340/514 |
| 2015/0256623 | A1 | 9/2015 | Ryhorchuk | |
| 2015/0326701 | A1 | 11/2015 | Robfogel | |
| 2015/0348399 | A1* | 12/2015 | Cree | G08B 29/12 340/514 |
| 2015/0365278 | A1 | 12/2015 | Chakrabarti | |
| 2016/0061795 | A1* | 3/2016 | Schultz | G01N 33/004 702/24 |
| 2016/0070276 | A1 | 3/2016 | Joshi | |
| 2016/0070614 | A1 | 3/2016 | Joshi | |
| 2016/0070920 | A1 | 3/2016 | Joshi | |
| 2016/0071148 | A1 | 3/2016 | Joshi | |
| 2016/0071183 | A1 | 3/2016 | Joshi | |
| 2016/0071184 | A1 | 3/2016 | Joshi | |
| 2016/0071219 | A1 | 3/2016 | Joshi | |
| 2016/0127878 | A1 | 5/2016 | Clarke | |
| 2016/0180467 | A1* | 6/2016 | Griffin | G06Q 40/08 705/4 |
| 2016/0183064 | A1 | 6/2016 | Wouhaybi | |
| 2016/0246473 | A1 | 8/2016 | Jobs | |
| 2016/0269533 | A1* | 9/2016 | Taylor | G08B 1/08 |
| 2016/0335857 | A1* | 11/2016 | Wedig | H04B 1/38 |

FOREIGN PATENT DOCUMENTS

| | | |
|---|---|---|
| JP | 2002077324 A | 3/2002 |
| WO | WO-01033178 | 5/2001 |
| WO | WO-2005063006 | 7/2005 |
| WO | WO-2007148299 | 12/2007 |

OTHER PUBLICATIONS

Albea, "High Performance Control Design for Dynamic Voltage Scaling Devices", IEEE Transactions on Circuits and Systems, Part 1, Regular Papers 58, 12, Nov. 17, 2011, pp. 2919-2930.

Baran, Paul, "Packet Switching", Fundamentals of Digital Switching, 2nd Ed., 1990, pp. 193-235.

Brown, Rick, "Nest pulls Protect Smoke Detector from Retail on Safety Issue", CNET. Retrieved from the Internet: <www.cnet.com/news/nest-pulls-protect-smoke-detector-from-retail-on-safety-issue>, accessed on Nov. 3, 2014, 3 pgs.

Carriazo-Osorio, Fernando, "Impacts of Air Pollution on Property Values: An Economic Valuation for Bogota, Columbia", Retrieved from the Internet: <http://www.demogr.mpg.de/papers/workshops/010518_paper02.pdf>, published on Aug. 19, 2007, 16 pgs.

"Chapter Five—Global Positioning System", Global Positioning System. Retreived from the Internet: <http://www.academia.edu/6330277/Chapter_5_Global_Positioning_System>, pp. 5.1-5.14.

Fadell, Tony. "Consumer Safety Notice for Nest Protect: Smoke + CO Alarm". Retrieved from the Internet: <Nest.com/letter-from-the-ceo>, published on Apr. 3, 2014, 3 pgs.

Dandamudi, Sivarama, "Interrupts", Fundamentals of Computer Organization and Design, Sep. 22, 2001, pp. 825-862.

Dijkman, Greg, "Scientific Gel and Blot Imaging: The difference between resolution and sensitivity with CCD cameras." Retrieved from the Internet: <gregdijkman.com/ccd-camera-imaging-sensitivity-resolution>, accessed on Nov. 5, 2014, 2 pgs.

"For $129, the best smoke detector on the market", CNET. Retrieved from the Internet: <http://www.cnet.com/products/nest-protect>, accessed on Jul. 8, 2014, 4 pgs.

Frederiksen, Rikard, "The optical sensitivity of compound eyes: theory and experiment compared", Bio. Lett., vol. 4, No. 6, Dec. 23, 2008, pp. 745-747.

"Guidance Regarding Methods for De-identification of Protected Health Information in Accordance with the Health Insurance Portability Act (HIPAA) Privacy Rule", Department of Health and Human Services. Retrieved from the Internet: <http://www.hhs.gov/ocr/privacy/hippa/understanding/coveredentities/De-identification/guidance.html>, accessed on Dec. 4, 2014, 18 pgs.

Hayashi, et al., "A Network-Centric approach to Sensor-data and Service Integration", SICE Annual Conference 2011, Sep. 13, 2011, pp. 2037-2042.

Huang, et al., "Pervasive, Secure Access to a Hierarchical Sensor-Based Healthcare Monitoring Architecture in Wireless Heterogeneous Networks", IEEE Journal on Selected Areas in Communication, vol. 27, No. 4, May 2009, pp. 400-411.

Mainwaring, "Wireless Sensor Networks for Habitat Monitoring", WNSA '02, Sep. 28, 2002, pp. 88-97.

Mccracken, Harry, "Nest's Smoke Detector 'Recall; Doesn't Mean You Need to Send Yours Back", Retrieved from the Internet: <http://time.com/108171/nest-recall/>, published on May 21, 2014, 2 pgs.

Miyaho, et al. "Sensor Network Management for Healthcare applications", 2010 Fifth International Conference on Systems and Networks Communications, 2010, pp. 14-20.

Moffat, "Notes on Using Thermocouples". Retrieved from the Internet: <http://www.electronics-cooling.com/1197/01/notes-on-using-thermocouples/>, accessed on Nov. 6, 2014, pp. 1-9.

Mogg, Trevor, "Nest Recall 440,000 Protect Smoke alarms, Issues Software Update that fixes Glitch". Retrieved from the Internet: <http://www.digitaltrends.com/home/nest-halts-sales-of-nest-protect-smoke-alarm/>, published on May 21, 2014, 5 pgs.

"Nest Labs Recall to Repair Nest Protect Smoke + CO Alarms Due to Failure to Sound Alert". Retrieved from the Internet: <http://www.cpsc/gov/en/Recalls/2014/Nest-Labs-Recalls-to-Repair-Nest-protect-Smoke-CO-Alarms>, published on May 21, 2014, 3 pgs.

"Nest Protect", Manual, Oct. 2013, 2 pgs.

Noh, Sun-Kuh et al. "Design of a Room Monitoring System for Wireless Sensor Networks", Intl. Journal of Distributed Sensor Networks, vol. 2013, Article Id 189840, 2013, 7 pages.

"Optical Resolution ." Retrieved from the Internet: <en.wikepedia.org/wiki.Optical_resolution>, accessed on Nov. 5, 2014, 11 pgs.

"Privacy Protector:6 Good Reasons to De-Indentify Data". Retrieved from the Internet: <http://privacyguidance.com/blog/6-good-reasons-to-de-identify-data>, accessed on Dec. 8, 2014, 6 pgs.

"Resolution and Sensitivity". Retrieved from the Internet: <www.atnf.csiro.au/outreach/education/senior/astrophysics/resolution sensitivity.html>, accessed on Nov. 5, 2014, 5 pgs.

Steenerson, Christopher E, "Education in Microscopy and Digital Imaging". Retrieved from the Internet: <zeiss-campus.magnets.fsu.edu/tutorials/basics/spatialfrequency/indexfalsh.html>, accessed on Nov. 5, 2014, 2 pgs.

"Symptom—Definition by Merriam-Webster", Retrieved from the Internet: <http://www.merriam-webster.com/medical/symptom/>, accessed on Dec. 4, 2014, 3 pgs.

"Tutorial on Spatial Frequency Analysis". Retrieved from the Internet: <www.psy.vanderbilt.edu/courses/hon185/SpatialFrequency/SpatialFrequency.html>, accessed on Nov. 5, 2014, 10 pgs.

(56) References Cited

OTHER PUBLICATIONS

"What is Nest Wave and how does it work?". Retrieved from the Internet: <support/nest.com/article/what-is-nest-wave-and-how-does-it-work>, accessed on Nov. 5, 2014, 3 pgs.
Yildiz, "Potential ambient Energy-Harvesting Sources and Techniques", The Journal of Technology Studies, vol. 35, No. 1. Fall 2009, pp. 1-14. Retrieved from the Internet: <http://scholar.lib.vt.edu/ejournals/JOTS/v351v35n1/yidliz.html>, accessed on Jan. 27, 2015.
International Application Serial No. PCT/US2016/60280, International Search Report dated May 22, 2017, 4 pgs.
International Application Serial No. PCT/US2016/60280, Written Opinion dated May 22, 2017, 9 pgs.
International Application Serial No. PCT/US2015/39622, Written Opinion dated Oct. 7, 2015, 6 pgs.
International Application Serial No. PCT/US2015/396.22, international Search Report dated Oct. 7, 2015, 2 pgs.
International Application Serial No. PCT/US2016/57243, International Search Report dated Mar. 10, 2017, 3 pgs.
International Application Serial No. PCT/US2016/57243, Written Opinion dated Mar. 10, 2017, 6 pgs.
U.S. Appl. No. 14/263,616, filed Apr. 28, 2014.
U.S. Appl. No. 14/263,668, filed Apr. 28, 2014.
U.S. Appl. No. 14/263,721, filed Apr. 28, 2014.
U.S. Appl. No. 14/283,075, filed May 20, 2014.
U.S. Appl. No. 14/640,738, filed Mar. 6, 2015.
U.S. Appl. No. 14/283,079, filed May 20, 2014.
U.S. Appl. No. 14/283,084, filed May 20, 2014.
U.S. Appl. No. 14/283,086, filed May 20, 2014.
U.S. Appl. No. 14/283,035, filed May 20, 2014.
U.S. Appl. No. 14/283,057, filed May 20, 2014.
U.S. Appl. No. 14/283,080, filed May 20, 2014.
U.S. Appl. No. 14/752,634, filed Jun. 26, 2015.
U.S. Appl. No. 14/283,097, filed May 20, 2014.
U.S. Appl. No. 14/316,446, filed Jun. 26, 2014.
U.S. Appl. No. 14/263,769, filed Apr. 28, 2014.
U.S. Appl. No. 14/263,802, filed Apr. 28, 2014.
U.S. Appl. No. 14/742,668, filed Jun. 17, 2015.
U.S. Appl. No. 14/263,838, filed Apr. 28, 2014.
U.S. Appl. No. 14/263,875, filed Apr. 28, 2014.
U.S. Appl. No. 14/263,899, filed Apr. 28, 2014.
U.S. Appl. No. 14/263,920, filed Apr. 28, 2014.
U.S. Appl. No. 14/535,249, filed Nov. 6, 2014.
U.S. Appl. No. 14/334,533, filed Jul. 17, 2014.
U.S. Appl. No. 14/334,550, filed Jul. 17, 2014.
U.S. Appl. No. 14/732,681, filed Jun. 6, 2015.
U.S. Appl. No. 14/334,567, filed Jul. 17, 2014.
U.S. Appl. No. 14/334,583, filed Jul. 17, 2014.
U.S. Appl. No. 14/334,598, filed Jul. 17, 2014.
U.S. Appl. No. 14/334,616, filed Jul. 17, 2014.
U.S. Appl. No. 14/448,849, filed Jul. 31, 2015.
U.S. Appl. No. 14/732,684, filed Jun. 6, 2015.
U.S. Appl. No. 14/467,872, filed Aug. 25, 2014.
U.S. Appl. No. 14/470,525, filed Aug. 27, 2014.
U.S. Appl. No. 14/470,753, filed Aug. 27, 2014.
U.S. Appl. No. 14/470,774, filed Aug. 27, 2014.
U.S. Appl. No. 14/732,683, filed Jun. 6, 2015.
U.S. Appl. No. 14/480,307, filed Sep. 8, 2014.
U.S. Appl. No. 14/848,195, filed Sep. 8, 2015.
U.S. Appl. No. 14/701,399, filed Apr. 30, 2015.
U.S. Appl. No. 14/701,410, filed Apr. 30, 2015.
U.S. Appl. No. 14/701,421, filed Apr. 30, 2015.
U.S. Appl. No. 14/701,435, filed Apr. 30, 2015.
U.S. Appl. No. 14/701,439, filed Apr. 30, 2015.
U.S. Appl. No. 14/701,445, filed Apr. 30, 2015.
U.S. Appl. No. 14/701,450, filed Apr. 30, 2015.
U.S. Appl. No. 14/701,451, filed Apr. 30, 2015.
U.S. Appl. No. 14/887,150, filed Oct. 19, 2015.
U.S. Appl. No. 14/887,220, filed Oct. 19, 2015.
U.S. Appl. No. 14/518,689, filed Oct. 20, 2014.

* cited by examiner

CALIBRATING AN ENVIRONMENTAL MONITORING DEVICE

CROSS-REFERENCE TO RELATED APPLICATION

This application claims the benefit of U.S. Provisional Patent Application No. 62/066,309, filed on Oct. 20, 2014, titled CALIBRATING ENVIRONMENTAL MONITORING DEVICE, the contents of which are herein incorporated by reference in their entirety.

BACKGROUND

Field

The described embodiments relate to techniques for calibrating an environmental monitoring device. In particular, the described embodiments relate to techniques for calibrating the detection of sound associated with a legacy device in an environment that includes the environmental monitoring device.

Related Art

Trends in connectivity and in portable electronic devices are resulting in dramatic changes in people's lives. For example, the Internet now allows individuals access to vast amounts of information, as well as the ability to identify and interact with individuals, organizations and companies around the world. This has resulted in a significant increase in online financial transactions (which are sometimes referred to as 'ecommerce'). Similarly, the increasingly powerful computing and communication capabilities of portable electronic device (such as smartphones), as well as a large and growing set of applications, are accelerating these changes, providing individuals access to information at arbitrary locations and the ability to leverage this information to perform a wide variety of tasks.

Recently, it has been proposed these capabilities be included in other electronic devices that are located throughout our environments, including those that people interact with infrequently. In the so-called 'Internet of things,' it has been proposed that future versions of these so-called 'background' electronic devices be outfitted with more powerful computing capabilities and networking subsystems to facilitate wired or wireless communication. For example, the background electronic devices may include: a cellular network interface (LTE, etc.), a wireless local area network interface (e.g., a wireless network such as described in the Institute of Electrical and Electronics Engineers (IEEE) 802.11 standard or Bluetooth® from the Bluetooth Special Interest Group of Kirkland, Wash.), and/or another type of wireless interface (such as a near-field-communication interface). These capabilities may allow the background electronic devices to be integrated into information networks, thereby further transforming people's lives.

However, the overwhelming majority of the existing background electronic devices in people's homes, offices and vehicles have neither enhanced computing capabilities (such as processor that can execute a wide variety of applications) nor networking subsystems. Given the economics of many market segments (such as the consumer market segment), these so-called 'legacy' background electronic devices (which are sometimes referred to as 'legacy electronic devices') are unlikely to be rapidly replaced. These barriers to entry and change are obstacles to widely implementing the Internet of things.

Hence, there is a need for an environmental monitoring device and associated systems that address the above-described problems.

SUMMARY

The described embodiments relate to a computer. This computer includes: an interface circuit that communicates with an environmental monitoring device and an electronic device associated with a user of the environmental monitoring device; memory that stores a program module; and a processor that executes the program module. During operation, the processor provides, to the electronic device, user-interface information associated with a user interface that allows the user to select a legacy device to monitor in an environment that includes the environmental monitoring device. This legacy device includes: a smoke detector, a carbon-monoxide detector, a dual smoke detector and carbon-monoxide detector, a burglar alarm, a car alarm, and/or another type of alarm device. Moreover, the processor receives, from the electronic device, a user selection in the user interface to monitor sound corresponding to an alarm output by the legacy device when the legacy device is activated. Then, the processor provides, to the electronic device, an instruction to activate the legacy device. Furthermore, the processor receives, from the environmental monitoring device, legacy-device information specifying whether the legacy device was detected and a type of legacy device identified based on the monitored alarm.

Note that the program module may be executed when the user calibrates the environmental monitoring device.

Moreover, the legacy-device information may include: a location of the legacy device, and/or an acoustic characteristic of the environment.

Furthermore, the processor may: provide, to the electronic device, second user-interface information associated with a second user interface that allows the user to select another legacy device to monitor; receive, from the electronic device, a second user selection in the second user interface to monitor sound corresponding to an alarm output by a second legacy device in the environment when the second legacy device is activated, where the second legacy device includes another instance of: the smoke detector, the carbon-monoxide detector, the dual smoke detector and carbon-monoxide detector, the burglar alarm, the car alarm, and/or the other type of alarm device; provide, to the electronic device, an instruction to activate the second legacy device; and receive, from the environmental monitoring device, second legacy-device information specifying whether the second legacy device was detected and the type of legacy device identified based on the monitored alarm.

Alternatively or additionally, the processor may: provide, to the electronic device, the second user-interface information associated with the second user interface that allows the user to select the other legacy device to monitor and to specify one or more contacts to notify when the legacy device is activated; receive, from the electronic device, a third user selection in the second user interface to specify the one or more contacts; and provide, to the electronic device, third user-interface information associated with a third user interface that allows the user to provide the one or more contacts and associated contact information.

In some embodiments, the processor provides, to the electronic device, remedial-action instructions when the legacy-device information indicates that the activated legacy device was not detected.

Moreover, the processor may: receive, from the electronic device, a fourth user selection in the user interface to remind the user later to monitor the sound corresponding to the alarm output by the legacy device when the legacy device is activated; and, after a predefined time interval, provide, to the electronic device, a reminder asking the user whether they want to monitor the sound corresponding to the alarm output by the legacy device when the legacy device is activated.

Note that, if the identified type of legacy device is indeterminate, the processor may: provide, to the electronic device, a request for the user to specify whether the legacy device is: the smoke detector, the carbon-monoxide detector, the dual smoke detector and carbon-monoxide detector, the burglar alarm, the car alarm, and/or the other type of alarm device; and receive, from the electronic device, a response to the request specifying the type of the legacy device.

In some embodiments, the processor: repeats the providing of the user-interface information, the receiving of the user selection, the providing of the instruction, and the receiving of the legacy-device information after: a time interval, when an object in the environment is repositioned, and/or when a wireless network that includes the environmental monitoring device is modified.

Another embodiment provides the environmental monitoring device, which may perform at least some of the aforementioned operations.

Another embodiment provides a computer-program product for use in conjunction with the computer and/or the environmental monitoring device. This computer-program product may include instructions for at least some of the aforementioned operations performed by the computer.

Another embodiment provides a method for calibrating the environmental monitoring device. This method may include at least some of the aforementioned operations performed by the computer.

The preceding summary is provided as an overview of some exemplary embodiments and to provide a basic understanding of aspects of the subject matter described herein. Accordingly, the above-described features are merely examples and should not be construed as narrowing the scope or spirit of the subject matter described herein in any way. Other features, aspects, and advantages of the subject matter described herein will become apparent from the following Detailed Description, Figures, and Claims.

BRIEF DESCRIPTION OF THE FIGURES

Note that like reference numerals refer to corresponding parts throughout the drawings. Moreover, multiple instances of the same part are designated by a common prefix separated from an instance number by a dash.

DETAILED DESCRIPTION

Figure 1:
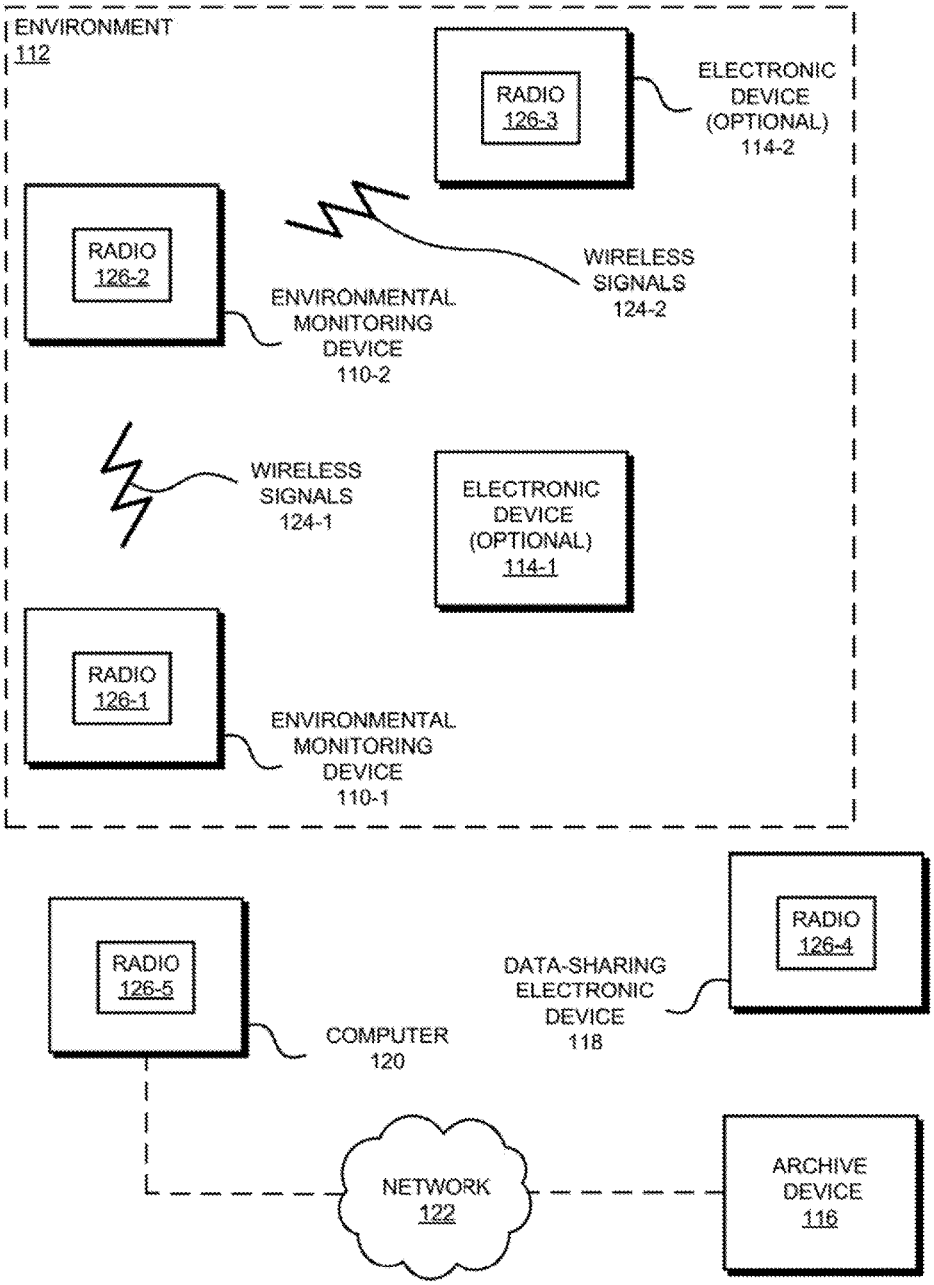
FIG. 1 is a block diagram illustrating electronic devices communicating in accordance with an embodiment of the present disclosure.

A computer that facilitates calibration of an environmental monitoring device is described. In particular, the computer may interact with an electronic device of a user of the environmental monitoring device to calibrate the environmental monitoring device. During the calibration, the computer provides user-interface information associated with a user interface that allows the user to select to select to monitor sound corresponding to an alarm output by a legacy device (such as a smoke detector) that is in an external environment that includes the environmental monitoring device. When the user selects to monitor a legacy device, the computer provides an instruction to the electronic device for the user to activate the legacy device. Then, the computer receives legacy-device information from the environmental monitoring device, specifying whether the legacy device was detected, a type of legacy device identified based on the monitored sound and/or a location of the legacy device.

By facilitating calibration of the environmental monitoring device, the computer may allow the environmental monitoring device to accurately monitor the environment and, in particular, one or more legacy devices. This monitoring may occur without direct communication (such as electrical or wireless communication) between the environmental monitoring device and a given legacy device. Consequently, the calibration technique may facilitate a backwards compatible service for the one or more legacy devices, so that the user does not have to upgrade or buy new electronic devices, which may improve user satisfaction with the environmental monitoring device.

Communication between electronic devices (such as the environmental monitoring device, the computer and/or another electronic device) may utilize wired, optical and/or wireless communication. For example, the wireless communication may involve communicating packets or frames that are transmitted and received by radios in the electronic devices in accordance with a communication protocol, such as: Bluetooth® (from the Bluetooth Special Interest Group of Kirkland, Wash.), an Institute of Electrical and Electronics Engineers (IEEE) 802.15 standard (such as ZigBee® from the ZigBee® Alliance of San Ramon, Calif.), an Institute of Electrical and Electronics Engineers (IEEE) 802.11 standard, Z-Wave, a power-line communication standard, an infra-red communication standard, a universal serial bus (USB) communication standard, a near-field-communication standard or specification (from the NFC Forum of Wakefield, Mass.), another wireless ad-hoc network standard, and/or another type of wireless interface. In some embodiments, the communication protocol may be compatible with a $2^{nd}$ generation or mobile telecommunication technology, a $3^{rd}$ generation of mobile telecommunications technology (such as a communication protocol that complies with the International Mobile Telecommunications-2000 specifications by the International Telecommunication Union of Geneva, Switzerland), a $4^{th}$ generation of mobile telecommunications technology (such as a communication protocol that complies with the International Mobile Telecommunications Advanced specification by the International Telecommunication Union of Geneva, Switzerland), and/or another cellular-telephone communication technique. For example, the communication protocol may include Long Term Evolution or LTE. In addition, the communication may occur via a wide variety of frequency bands, including frequencies associated with the so-called 'white space' in frequencies bands associated with analog television broadcasting.

The communication between the electronic devices is shown in FIG. 1, which presents a block diagram illustrating communication among environmental monitoring devices 110, optional electronic devices 114 (such as regulator devices e.g., optional electronic device 114-2, and/or legacy electronic devices, e.g., optional electronic device 114-1) and data-sharing electronic device 118 using wireless signals, and communication with computer 120 and network 122 (such as the Internet, a wireless local area network, an Ethernet network, an intra-net, an optical network, etc.) and aggregating or archive device 116 (which may or may not involve wireless signals). In particular, the communication between environmental monitoring devices 110, optional electronic devices 114, archive device 116, data-sharing electronic device 118 and/or computer 120 may involve the exchange of packets. These packets may be included in frames in one or more wireless channels.

Moreover, as described further below with reference to FIG. 20, environmental monitoring devices 110, archive device 116, data-sharing electronic device 118, computer 120 and/or optionally some of optional electronic devices 114 (such as optional electronic device 114-2) may include subsystems, such as: a networking subsystem, a memory subsystem, a processing subsystem, an optional user-interface subsystem, and a sensor subsystem. In addition, these electronic devices may include radios 126 in the networking subsystems. More generally, environmental monitoring devices 110, archive device 116, data-sharing electronic device 118, computer 120 and/or optionally some of optional electronic devices 114 can include (or can be included within) any electronic devices with networking subsystems that enable wirelessly communication with another electronic device. This can comprise transmitting frames on wireless channels to enable the electronic devices to make initial contact, followed by exchanging subsequent data/management frames (such as connect requests or petitions to establish a connection or link), configuring security options (e.g., encryption on a link or in a mesh network), transmitting and receiving packets or frames, etc.

As can be seen in FIG. 1, wireless signals 124 (represented by jagged lines) are transmitted from/received by radios 126 in environmental monitoring devices 110, data-sharing electronic device 118, computer 120 and/or optionally some of optional electronic devices 114 (such as optional electronic device 114-2). In general, wireless communication among these electronic devices may or may not involve a connection being established among the electronic devices, and therefore may or may not involve communication via a wireless network. (Note that the communication between computer 120 and archive device 116 may occur via network 122, which may involve wired or optical communication with a different communication protocol than wireless signals 124.)

Furthermore, the processing of a packet or frame in an electronic device (such as environmental monitoring device 110-1) may include: receiving wireless signals 124 with the packet or frame; decoding/extracting the packet or frame from received wireless signals 124 to acquire the packet or frame; and processing the packet or frame to determine information contained in the packet or frame (such as at least a portion of a data packet).

As described further below with reference to FIGS. 2-19, environmental monitoring devices 110 may monitor environmental conditions in an environment 112 (which is sometimes referred to as an 'external environment'), such as a portion of a building, the building, a container or a package, a vehicle, a liquid, and/or a train car. (Note that one or more of environmental monitoring devices 110 may be immersed in a liquid, and environment 112 may be at a fixed location or time-varying locations.) For example, at least some of environmental monitoring devices 110 may include sensors (or sensor devices) that provide sensor data that reflects the environmental conditions in environment 112. In general, the sensor data may be provided without or excluding interaction (such as wireless communication and/or electrical coupling) among environmental monitoring devices 110 and at least some of optional electronic devices (such as optional electronic device 114-1). Thus, sensors in environmental monitoring devices 110 may indirectly infer information about the operation and/or the performance of optional electronic devices 114 based on the monitored environmental conditions. However, in some embodiments at least some of environmental monitoring devices 110 interact directly with at least some of optional electronic devices 114 (via communication or electrical coupling), thereby facilitating direct measurement of the sensor data, as well as feedback control of these electronic devices by at least some of environmental monitoring devices 110. In some embodiments, one or more of environmental monitoring devices 110 is integrated into one or more other electronic device, such as one or more of optional electronic devices 114.

The sensor data may be analyzed locally by at least one of environmental monitoring devices 110 and/or remotely by archive device 116. Moreover, the sensor data and/or the analyzed sensor data may be communicated among environmental monitoring devices 110. In particular, environmental monitoring devices 110 may form a ZigBee® mesh network, with ZigBee® end devices communicating with a ZigBee® coordinator (such as environmental monitoring device 110-1) via one or more optional ZigBee® routers. Then, environmental monitoring device 110-1 may communicate (wirelessly and/or via computer 120 and network 122) the sensor data and/or the analyzed sensor data to archive device 116.

In addition, the sensor data and/or the analyzed sensor data may be communicated or shared with one or more other electronic devices, such as data-sharing electronic device 118 (e.g., a cellular telephone or a portable electronic device) and/or remote servers or computers not shown in FIG. 1. For example, the sensor data and/or the analyzed sensor data may be communicated to data-sharing electronic device 118 by at least some of environmental monitoring devices 110, such as the one or more optional ZigBee® routers and/or the ZigBee® coordinator. (Thus, at least some of environmental monitoring devices 110 may function as sensor-data hubs for other environmental monitoring devices 110.) Alternatively, the sensor data, the analyzed sensor data and/or operational information (such as remaining battery life or a time history of the environmental condition) from at least some of environmental monitoring devices 110 may be communicated to data-sharing electronic device 118 by archive device 116 and/or computer 120 using wired, optical and/or wireless communication. Data-sharing electronic device 118 may display or provide this information to a user or an individual (who may be a user of one of environmental monitoring devices 110 or another individual, such as an emergency contact specified by a user or an owner of one of environmental monitoring devices 110). In some embodiments, data-sharing electronic device 118 compares the information from multiple environmental monitoring devices 110 to ensure consistency before presenting the information to the user or the individual. This may reduce the likelihood of false alarms or misinformation. Alternatively, data-sharing electronic device 118 can present comparisons of the information from multiple environmental monitoring devices 110.

The sensor data, the analyzed sensor data and/or information that is communicated and/or stored by environmental monitoring devices 110 and/or archive device 116 may be protected. This may involve encryption using an encryption key (such as an encryption key associated with one of environmental monitoring devices 110 and/or a secure channel in a processor in one of environmental monitoring devices 110). The encryption key may use symmetric or asymmetric encryption techniques. Alternatively or additionally, a secure or one-way cryptographic hash function (such as SHA-256) may be used. For example, the secure hash may supplement encryption that is associated with a network interface in one or more of environmental monitoring devices 110. In some embodiments, the information communicated and/or stored in FIG. 1 is digitally signed by environmental monitoring devices 110.

Furthermore, archive device 116 may store the sensor data and/or the analyzed sensor data in secure, certified historical records or logs of the environmental conditions in environment 112. In principle, the information stored by archive device 116 may be protected. However, in some embodiments, users of environmental monitoring devices 110, who, in general, control how their data is used and shared, may instruct environmental monitoring devices 110 to provide, via the mesh network, information to archive device 116 that allows archive device 116 to unprotect the sensor data and/or the analyzed sensor data. Similarly, in response to requests from authorized recipients for the sensor data and/or the analyzed sensor data (such as a request from data-sharing electronic device 118), archive device 116 may provide access to the stored sensor data and/or the analyzed sensor data (such as the time history of the environmental condition). If the sensor data and/or the analyzed sensor data are protected, the associated environmental monitoring devices 110 may provide protection information to data-sharing electronic device 118 that allows data-sharing electronic device 118 to unprotect the sensor data and/or the analyzed sensor data.

Environmental monitoring devices 110 may allow a variety of services to be offered to: users associated with environmental monitoring devices 110 (such as owners or renters of these environmental monitoring devices), another individual (such as an emergency contact), suppliers of components or spare parts, maintenance personnel, security personnel, emergency service personnel, insurance companies, insurance brokers, realtors, leasing agents, apartment renters, hotel guests, hotels, restaurants, businesses, organizations, governments, potential buyers of physical objects, a shipping or transportation company, etc. For example, based on the analyzed sensor data feedback about the operation of one or more of optional electronic devices 114 (such as a legacy electronic device) may be provided by one or more of environmental monitoring devices 110 on displays, using speakers and, more generally, on physiological output devices that provide sensory information (such as lighting or an illumination pattern). Thus, a user or an individual may be alerted if a legacy electronic device is activated or if it is not functioning properly. More generally, the feedback may indicate the presence of an environmental condition in environment 112, such as: presence of an allergen, fire, flooding, a power outage, a chemical contaminant, an infestation, opening of a door, an individual entering or leaving a room, an individual getting out of bed, an individual waking up, an individual crying, an individual tossing and turning in bed, an individual shivering, a change in health condition of an individual (such as an illness, a chronic disease, etc.), etc. In some embodiments, such as when the environmental condition includes activation of an alarm, the feedback may be presented to the individual in a user interface (e.g., on data-sharing electronic device 118). This user interface may include or specify a notification about the environmental condition, such as an alarm sounding, and may include one or more icons that allow the individual to: listen to an audio recording of sounds associated with the environmental condition, contact emergency services, and/or indicate that the environmental condition is a false positive.

As noted previously, the environmental condition monitored by one or more environmental monitoring devices 110 may include the presence of an alarm sounding. For example, when an alarm device (such as a smoke detector, a carbon-monoxide detector, a dual smoke detector and carbon-monoxide detector, a car alarm, a burglar alarm and/or another alarm) is activated and sounds an audible acoustic alert or alarm, one of environmental monitoring devices 110 may detect the sound (such as based on time-domain or frequency-domain information in temporal audio samples of the sound received by a microphone) and provide the notification to the individual. (For example, the sound may include a temporal 3 acoustic pattern, with a beep, pause and an alarm pattern or signal, which is compatible with an American National Standards Institute standard S3.42 1990.) To facilitate this capability, a given one of environmental monitoring devices 110 may be calibrated (e.g., using the given one of environmental monitoring devices 110 and/or computer 120) to: confirm that the alarm can be heard or detected by the given one of environmental monitoring devices 110, identify the alarm device, determine the location of the alarm device, determine an acoustic characteristic of environment 112, and/or provide contacts and contact information where notifications are sent. This calibration may occur: when the given one of environmental monitoring devices 110 is first installed or used, after a time interval (such as every 3 or 6 months) and/or when environment 112 is changed (such as when objects in environment 112 are moved, when the given one of environmental monitoring devices 110 is moved, when a wireless network that communicates with the given one of environmental monitoring devices 110 is modified, etc.). Note that the acoustic characteristic may include: a location of the alarm device (such as a location of the alarm device relative to the given one of environmental monitoring devices 110); a detection threshold for the given one of environmental monitoring devices 110 at its current location to use when determining if the alarm device is activated; and/or an acoustic transfer function (such as an amplitude and/or phase as a function of frequency) or an acoustic profile (such as an acoustic latency or a delay of an echo) of environment 112 proximate to the alarm device and the given one of environmental monitoring devices 110. Moreover, the location of the alarm device may be specified by: an image of environment 112, a positioning system (such as GPS), a communication network (such as a cellular-telephone network), and/or an acoustic latency in environment 112.

In some embodiments, a regulator device (such as one of optional electronic devices 114, e.g., a thermostat, a humidifier, a space heater, an air purifier, a ventilator device, a fan, a motor, a window opener, a door opener, an access-control device for the environment, etc.) that regulates an environmental condition is modified based on a comparison of the sensor data and a target value of the environmental condition in environment 112. For example, one of environmental monitoring devices 110 may provide a control signal to the regulator device to modify an environmental condition (such as the temperature, humidity, airflow, etc.) based on a comparison of the sensor data and a target value performed by the environmental monitoring device, or another technique (which may be implemented using software) that uses an environmental condition as an input. (Note that the regulator device may include its own environmental sensor or thermostat, as well as a control mechanism and/or a switching mechanism to turn the regulator device on and off based on measurements provided by the environmental sensor. Thus, environmental monitoring devices 110 may perform measurements and/or may selectively electrically couple the regulator device to a power source using an environmental sensor, control mechanism and/or a switching mechanism that are in addition to those included in the regulator device.)

In these ways, environmental monitoring devices 110, data-sharing electronic device 118 and/or computer 120 may be used to: implement an information network with one or more legacy electronic devices; securely aggregate and selectively disseminate sensor data about environmental conditions; provide feedback about one or more environmental conditions in environment 112 (such as the notifications with the audio recordings, or an intuitive, non-graphical representation of the time history of the environmental condition); allow users to remotely control alerts or notifications provided by environmental monitoring devices 110 by modifying alert settings of environmental monitoring devices 110; selectively change a switching state of a switch in at least one of environmental monitoring devices 110 based at least on one or more environmental conditions in environment 112; facilitate monitoring and maintaining of the one or more environmental conditions in environment 112; and/or calibrate environmental monitoring devices 110.

Although we describe the environment shown in FIG. 1 as an example, in alternative embodiments, different numbers or types of electronic devices may be present. For example, some embodiments comprise more or fewer electronic devices.

Figure 2:
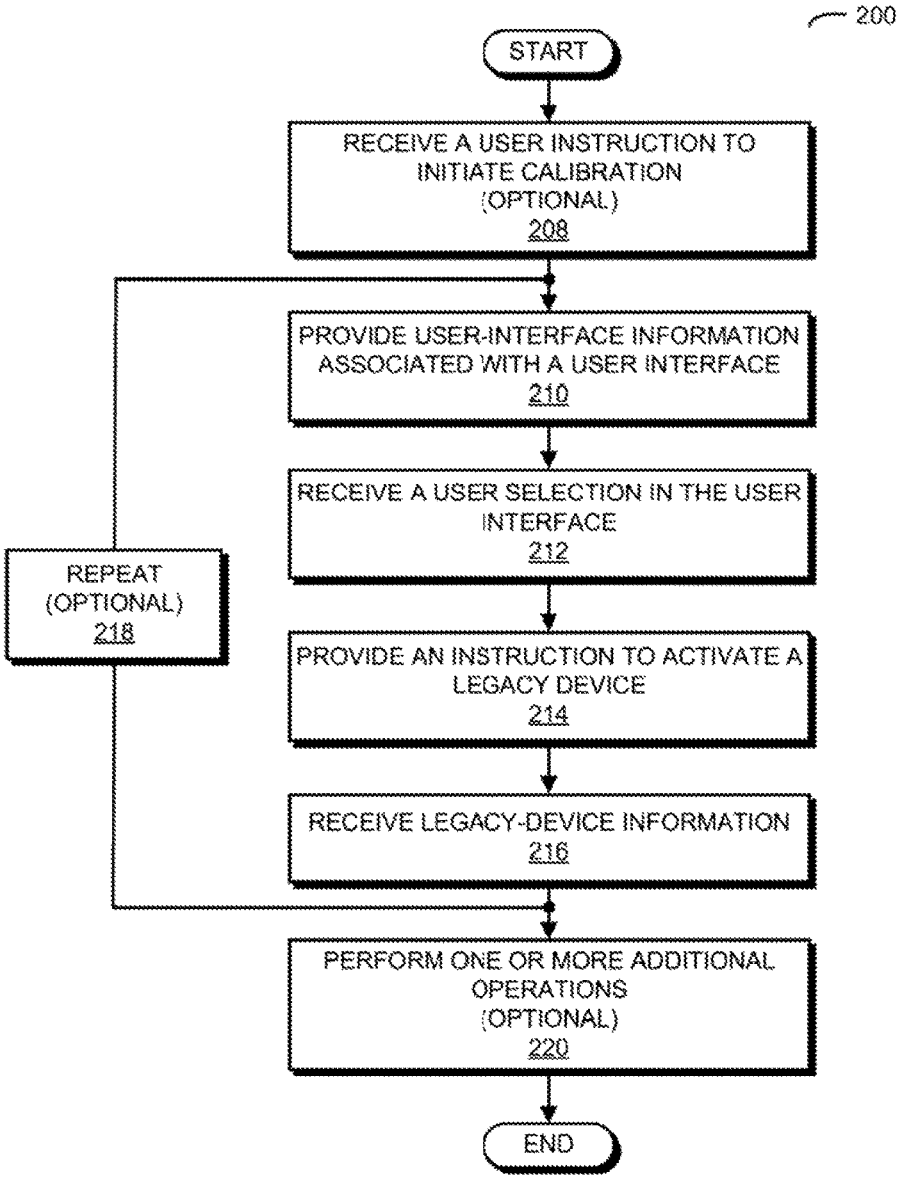
FIG. 2 is a flow diagram illustrating a method for calibrating an environmental monitoring device in FIG. 1 in accordance with an embodiment of the present disclosure.
Figure 3:
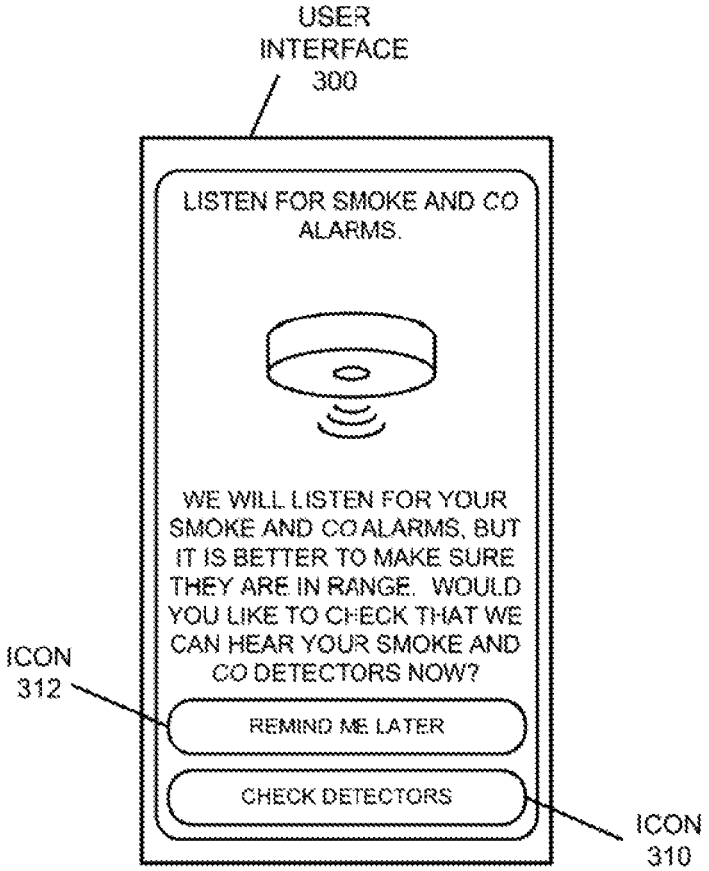
FIG. 3 is a drawing illustrating a user interface associated with the method of FIG. 2 in accordance with an embodiment of the present disclosure.
Figure 4:
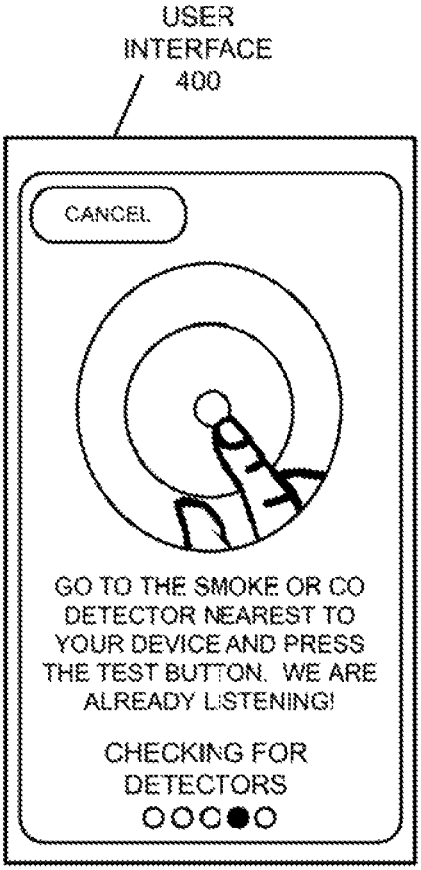
FIG. 4 is a drawing illustrating a user interface associated with the method of FIG. 2 in accordance with an embodiment of the present disclosure.
Figure 5:
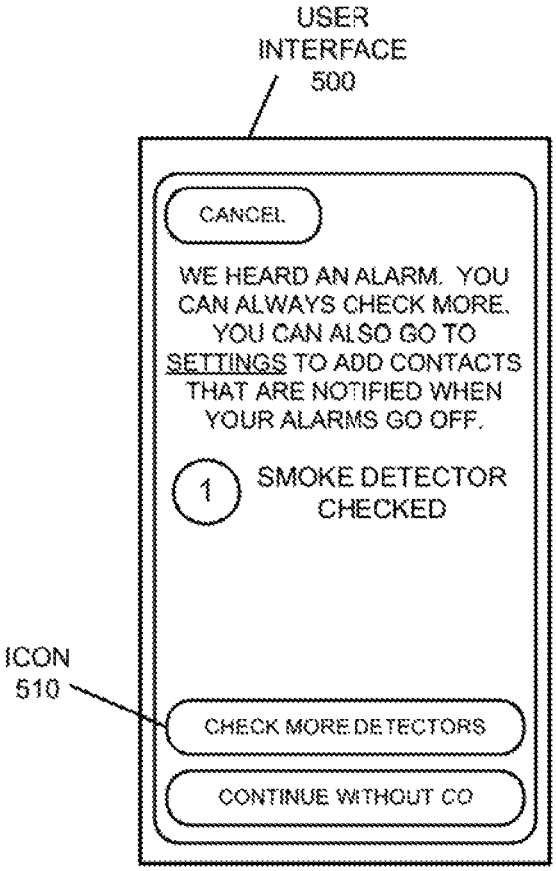
FIG. 5 is a drawing illustrating a user interface associated with the method of FIG. 2 in accordance with an embodiment of the present disclosure.
Figure 6:
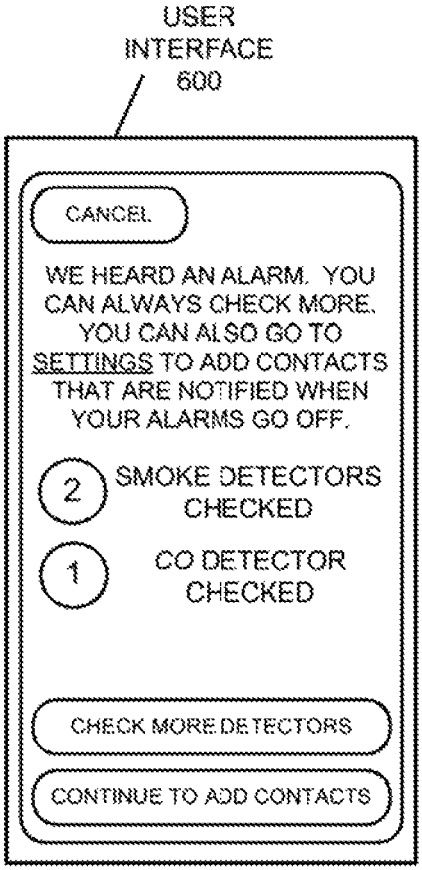
FIG. 6 is a drawing illustrating a user interface associated with the method of FIG. 2 in accordance with an embodiment of the present disclosure.
Figure 7:
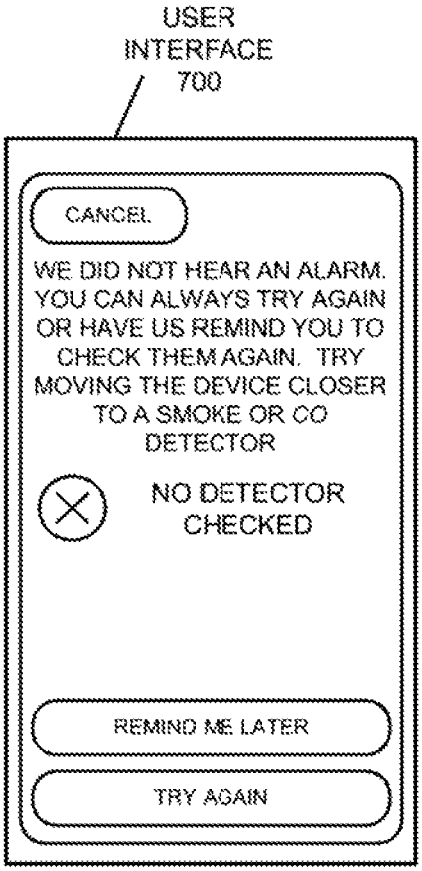
FIG. 7 is a drawing illustrating a user interface associated with the method of FIG. 2 in accordance with an embodiment of the present disclosure.
Figure 8:
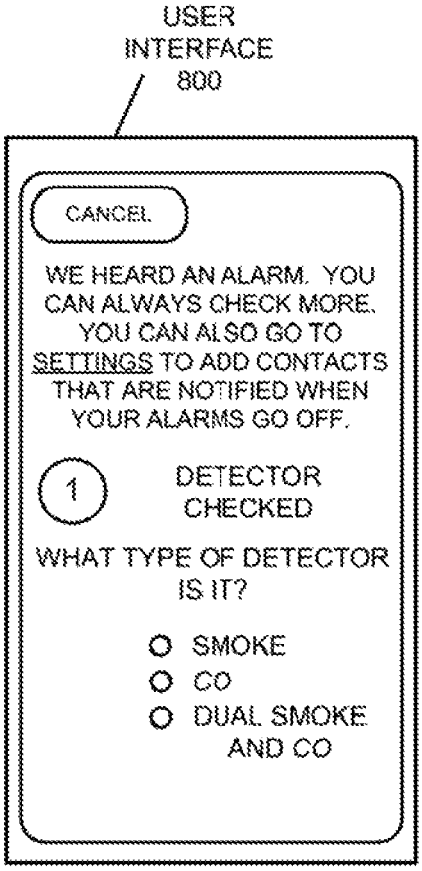
FIG. 8 is a drawing illustrating a user interface associated with the method of FIG. 2 in accordance with an embodiment of the present disclosure.
Figure 9:
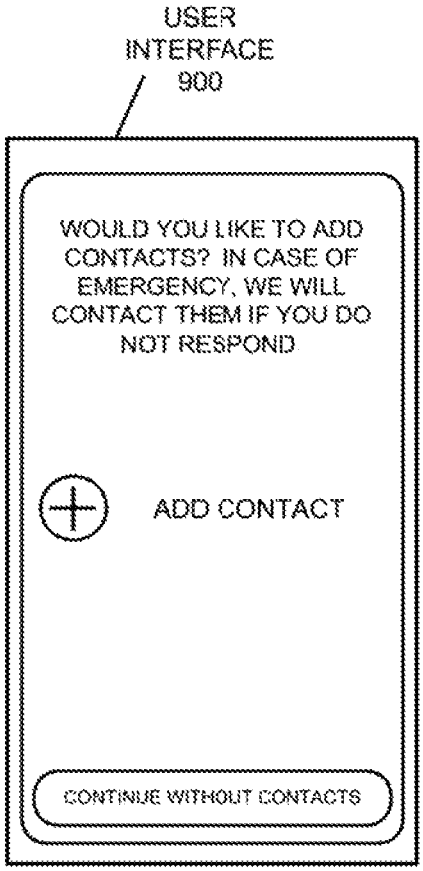
FIG. 9 is a drawing illustrating a user interface associated with the method of FIG. 2 in accordance with an embodiment of the present disclosure.

We now further describe the calibration technique. FIG. 2 presents a flow diagram illustrating a method 200 for calibrating an environmental monitoring device (such as one of environmental monitoring devices 110 in FIG. 1), which may be performed by a computer (such as computer 120 in FIG. 1) and an electronic device (such as data-sharing electronic device 118 in FIG. 1) that is associated with a user (who may or may not be a user of the environmental monitoring device). (However, as noted previously, the environmental monitoring devices may perform some of all of the operations in method 200, i.e., environmental monitoring devices 110 in FIG. 1 may calibrate themselves in conjunction with data-sharing electronic device 118 in FIG. 1). During operation, the computer, provides, to the electronic device, user-interface information associated with a user interface (operation 210) that allows the user to select a legacy device (and, more generally, an alarm device that selectively outputs sound based on the environmental condition) to monitor in an environment that includes the environmental monitoring device. (In some embodiments, the computer provides information that the electronic device or an application executing on the electronic device uses to generate and display the user interface. Thus, the user interface may be specified in the user-interface information provided by the computer or may be generated by the electronic device based on the user-interface information.) For example, as described further below with reference to FIGS. 3-9, the user interface may include an icon that the user can click on or touch to select a particular legacy device. Note that the legacy device may include: a smoke detector, a carbon-monoxide detector, a dual smoke detector and carbon-monoxide detector, a burglar alarm, a car alarm, and/or another type of alarm device.

Moreover, the computer receives, from the electronic device, a user selection in the user interface (operation 212) to monitor sound corresponding to an alarm output by the legacy device when the legacy device is activated.

In response, the computer provides, to the electronic device, an instruction to activate the legacy device (operation 214). Furthermore, the computer receives, from the environmental monitoring device, legacy-device information (operation 216) specifying whether the legacy device was detected and a type of legacy device identified (such as a smoke detector) based on the monitored sound. In some embodiments, the legacy-device information includes: a location of the legacy device (which may be determined by trilateration, triangulation and/or based on the monitored sound), and/or an acoustic characteristic of the environment. (For example, the location may be determined using multiple microphones.) Thus, the location may be absolute or relative (such as a position in the external environment relative to the environmental monitoring device).

Note that the computer may perform the operations in method 200 when the user calibrates the environmental monitoring device. For example, method 200 may be performed when the user first turns on the environmental monitoring device. In some embodiments, the computer repeats: the providing of the user-interface information (operation 210), the receiving of the user selection (operation 212), the providing of the instruction (operation 214), and the receiving of the legacy-device information (operation 216) after: a time interval (such as 3 or 6 months), when objects in the environment (such as the furniture, the legacy device and/or the environmental monitoring device) are repositioned, and/or when a wireless network that includes the environmental monitoring device is modified (such as when an electronic device joins or leaves the wireless network).

Additionally, the computer may optionally repeat 218 operations 210-216 for one or more other legacy devices in the environment. For example, the computer may: provide, to the electronic device, second user-interface information associated with a second user interface that allows the user to select another legacy device to monitor; receive, from the electronic device, a user selection in the second user interface to monitor the sound corresponding to an alarm output by a second legacy device in the environment when the second legacy device is activated, where the second legacy device includes another instance of: the smoke detector, the carbon-monoxide detector, the dual smoke detector and carbon-monoxide detector, the burglar alarm, the car alarm, and/or the other type of alarm device; provide, to the electronic device, an instruction to activate the second legacy device; and receive, from the environmental monitoring device, second legacy-device information specifying whether the second legacy device was detected and the type of legacy device identified based on the monitored alarm.

In some embodiments, the computer performs one or more additional operations (operation 220). For example, the second user interface may allow the user to specify one or more contacts to notify when the environmental monitoring device detects that the legacy device is activated. When the user clicks on or activates an icon in the second user interface, the user may be queried for the one or more contacts and their associated contact information (such as telephone numbers, email addresses, etc.) so that the electronic device can contact the one or more contacts when the legacy device is activated (as determined by the environmental monitoring device detecting sound corresponding to an alarm or alert output by the legacy device). In particular, the computer may optionally: receive, from the electronic device, another user selection in the second user interface to specify the one or more contacts; and provide, to the electronic device, third user-interface information associated with a third user interface that allows the user to provide the one or more contacts and associated contact information.

Alternatively or additionally, the computer may provide, to the electronic device, remedial-action instructions when the legacy-device information indicates that the activated legacy device was not detected (i.e., when the environmental monitoring device indicates the legacy device was not detected or the sound of an alarm was not received). For example, the user may be asked to repeat the calibration and/or to move the environmental monitoring device and/or the legacy device in the external environment (such as when there is too much background noise or the sound associated with the alarm is below a minimum detection threshold value).

In some embodiments, the user can elect to conduct the calibration later. For example, the computer may: receive, from the electronic device, a user selection in the user interface to remind the user later to monitor the sound corresponding to the alarm output by the legacy device when the legacy device is activated; and, after a predefined or user-specified time interval (such as 15 minutes, an hour, a day or a week), provide, to the electronic device, a reminder (such as an email or a text) asking the user whether they want to monitor the sound corresponding to the alarm output by the legacy device when the legacy device is activated.

Note that, if the identified type of legacy device is indeterminate (or has an estimated accuracy that is below an identification threshold), the computer may: provide, to the electronic device, a request for the user to specify whether the legacy device is: the smoke detector, the carbon-monoxide detector, the dual smoke detector and carbon-monoxide detector, the burglar alarm, the car alarm, and/or the other type of alarm device; and receive, from the electronic device, a response to the request specifying the type of the legacy device. In this way, the user can confirm the type of legacy device when the environmental monitoring device is unable to do so accurately.

In some embodiments of method 200 (FIG. 2), there may be additional or fewer operations. For example, the computer may optionally receive, from the electronic device, an optional user instruction to initiate calibration (operation 208). In particular, the user may launch a calibration application. Alternatively, method 200 may be initiated by the computer when the environmental monitoring device is first activated, after a time interval since a previous calibration, when a change in a wireless network that includes the environmental monitoring device is detected, etc. Moreover, the order of the operations may be changed, and/or two or more operations may be combined into a single operation.

In an exemplary embodiment, the computer provides information associated with and/or instructions for one or more user interfaces that are displayed on the electronic device (such as the user's cellular telephone). In particular, the computer may provide the instructions for the user interface, or may provide information that the electronic device or an application executing on the electronic device can use to generate and display the user interface (either or both of which are sometimes referred to as 'user-interface information'). Thus, the user interface may be specified by the computer in a message, e.g., a message may include instructions for the user interface, or the message may include information that is used by the electronic device to generate the user interface. By selecting icons in the one or more user interfaces and activating one or more legacy devices (such as alarm devices) when instructed to do so, the computer implementing the calibration technique may facilitate the calibration of the environmental monitoring device.

The one or more user interfaces are shown in FIGS. 3-9. In particular, in user interface 300 there may be an icon 310 that the user can select to check for one or more smoke detectors or carbon-monoxide (CO) detectors. In addition, there may be an icon 312 that the user can select to delay the calibration until later.

If the user selects or activates icon 310, user interface 400 may instruct the user to activate one of the smoke detectors. Moreover, when the sound of the alarm from this smoke detector is detected, user interface 500 may be provided to the electronic device and displayed. In this user interface, the user may be notified that a smoke detector was detected. In addition, there may be an icon 510 that allow the user to check for more smoke detectors or to check for a carbon-monoxide detector.

If the user selects or activates icon 510, the computer may instruct the user to activate additional smoke detectors and/or the carbon-monoxide detector. In particular, when the sound of the alarms from the one or more additional alarm devices are detected, user interface 600 may be displayed on the electronic device. This user interface may summarize the alarm devices detected so far. It may also provide icons that allow the user to check for more detectors or to add or provide contacts that will be notified with one of the detected alarm devices is activated (i.e., sounding an alarm).

Alternatively, if the environmental monitoring device reports that it was unable to detect a smoke detector or a carbon-monoxide detector after the computer (via a user interface displayed on the electronic device) instructed the user to activate the smoke detector or the carbon-monoxide detector, the computer may provide information to the electronic device so user interface 700 is displayed. This user interface includes suggested remedial action(s), such as moving the alarm device and/or the environmental monitoring device. User interface 700 also includes icons that allow the user to try the calibration again or to wait until later (and to ask the computer to remind the user after a time interval has elapsed).

Furthermore, when an alarm device is detected during the calibration technique, but the environmental monitoring device is unable to determine the type of legacy device (e.g., the determined type is indeterminate), the computer may provide information to the electronic device so user interface 800 is displayed. This user interface may provide radio buttons that allow the user to specify whether the detected alarm device is: a smoke detector, a carbon-monoxide detector or a dual smoke detector and carbon-monoxide detector.

Additionally, the user may be asked to provide contacts and contact information to associate with a detected alarm device. By activating the '+' icon in user interface 900, another user interface may be displayed on electronic device, which allows the user to specify names of one or more contacts, and to provide associated contact information (such as a telephone number and/or an email address). As described further below with reference to FIGS. 11-13, subsequently, if the alarm device is activated and outputs an audible alarm or alert, the contact information may be accessed and a notification is provided to the one or more contacts associated with the alarm device.

Figure 10:
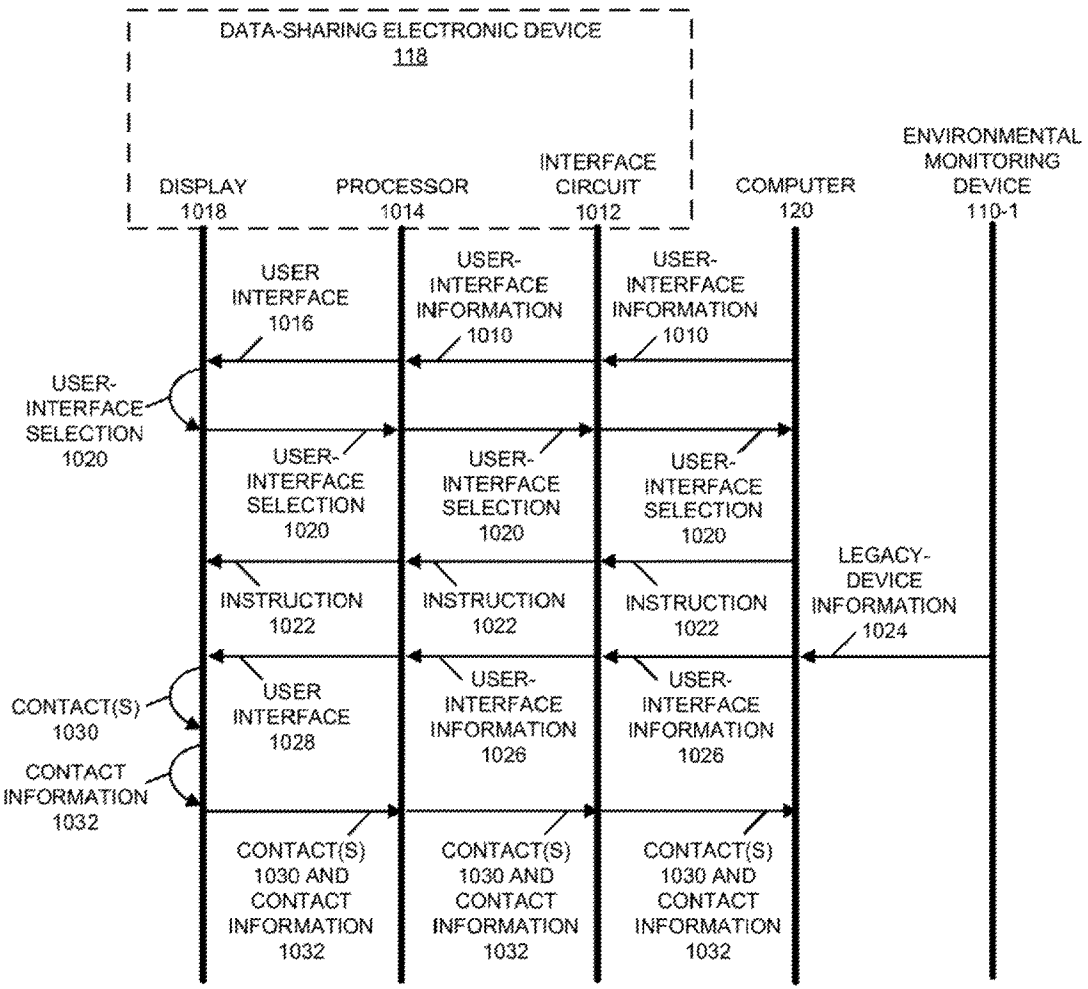
FIG. 10 is a drawing illustrating communication among at least some of the electronic devices of FIG. 1 in accordance with an embodiment of the present disclosure.

Embodiments of the communication technique are further illustrated in FIG. 10, which presents a drawing illustrating communication between data-sharing electronic device 118 and computer 120 in FIG. 1. In particular, computer 120 may provide user-interface information 1010 to interface 1012 in data-sharing electronic device 118. This user-interface information may be associated with a user interface that allows the user to select a legacy device to monitor in an environment that includes the environmental monitoring device. Then, processor 1014 in data-sharing electronic device 118 may display user interface 1016 on display 1018 based on user-interface information 1010. Moreover, data-sharing electronic device 118 may receive a user-interface selection 1020 (such as when the user clicks on or touches an icon in user interface 1012) to select a particular legacy device to monitor. In particular, the monitoring may involve listening for sound corresponding to an alarm output by the legacy device when the legacy device is activated.

Next, data-sharing electronic device 118 may provide user-interface selection 1020 to computer 120. In response, computer 120 may provide an instruction 1022 to activate the legacy device. The user may then activate the legacy device, which then outputs the alarm. For example, the user may push a test button on the legacy device to activate it.

Furthermore, computer 120 may receive, from environmental monitoring device 110-1, legacy-device information 1024 specifying whether the legacy device was detected, a type of legacy device identified (such as a smoke detector) based on the monitored alarm, a location of the legacy device, and/or an acoustic characteristic of the environment that includes environmental monitoring device 110-1 and the legacy device.

Additionally, computer 120 may provide user-interface information 1026 to data-sharing electronic device 118. This user-interface information may be associated with a user interface 1028 that allows the user to specify one or more contacts and associated contact information for legacy device 1016. Then, data-sharing electronic device 118 may receive one or more contacts 1030 and contact information 1032 from the user (e.g., the user may enter this information, or it may be extracted from text using optical character recognition and/or from speech using speech recognition). Moreover, data-sharing electronic device 118 may provide one or more contacts 1030 and contact information 1032 to computer 120.

In these ways, the electronic device and the computer (such as software, e.g., a calibration application, executed by a processor) may facilitate calibration of the environmental monitoring device. This may allow the environmental monitoring device to subsequently and accurately detect when a legacy device (such as an alarm device that cannot electrically or wirelessly communicate with the environmental monitoring device) is activated, such as when the legacy device is outputting an alarm or an alert. In turn, as described further below with reference to FIGS. 11-13, this may allow the environmental monitoring device to provide notifications to the electronic device. More generally, the calibration may allow additional tasks, services and applications to be flexibly implemented using the environmental monitoring device. In particular, the calibration may allow the environmental monitoring device to monitor the environmental condition in the environment. This monitoring may allow the environmental monitoring device to adapt or change the function or operation of one or more electronic devices in FIG. 1 (such as a legacy electronic device and/or a regulator device) based on the needs or preferences of the user associated with the electronic device, who is, therefore, in proximity. In this way, an environmental condition (such as the temperature, humidity, an illumination pattern, etc.) in the external environment may be dynamically modified. In addition, once the information associated with the environmental monitoring device is known, the service(s) may include maintenance notifications about electronic devices in FIG. 1. For example, the environmental monitoring device may include one or more sensors that monitor the environmental condition in the environment (such as an acoustic signal from a fire or carbon-monoxide detector that indicates a failing battery). Based on the environmental condition, the environmental monitoring device may provide a maintenance notification to a user's cellular telephone to replace the battery or to perform another remedial action (such as a repair or service to be performed on a legacy device). Consequently, the improved functionality and services facilitated by the calibration technique may promote sales of the environmental monitoring device (and, more generally, commercial activity) and may enhance customer satisfaction with the environmental monitoring device.

Figure 11:
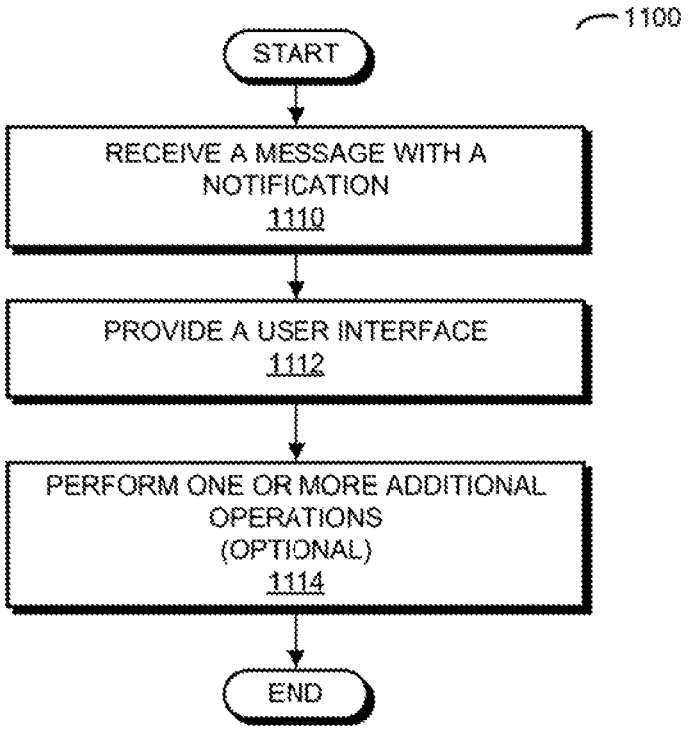
FIG. 11 is a flow diagram illustrating a method for providing a message associated with operation of an environmental monitoring device in FIG. 1 in accordance with an embodiment of the present disclosure.

We now further describe the communication technique. FIG. 11 presents a flow diagram illustrating a method 1100 for providing a message associated with operation of an environmental monitoring device (such as environmental monitoring device 110-1 in FIG. 1), which may be performed by an electronic device (such as data-sharing electronic device 118 in FIG. 1). The counterpart operations to method 1100 may be performed by a computer (such as computer 120 in FIG. 1). However, in other embodiments some or all of the counterpart operations to method 1100 are performed by the environmental monitoring device, i.e., the environmental monitoring device can provide the notifications to the electronic device without using computer 120 in FIG. 1 as an intermediary.

During operation, the electronic device receives, from the computer, a message with a notification (operation 1110) based on an environmental condition in an external environment that includes the environmental monitoring device and an audio recording of sounds associated with the environmental condition. For example, an alarm may be sounding in the external environment, and the environmental monitoring device may provide a notification about the alarm and an audio recording of the sound of the alarm (or a link to a location of the audio recording) to the computer. In response, the computer may access registered-device information specifying the electronic device. For example, the registered-device information, which may be predefined by an owner or user of the environmental monitoring device, may specify the electronic device. Moreover, the registered-device information may include one or more contacts (such as the user, another individual, a group of individuals, etc.) and contact information for these people (such as telephone numbers and/or email addresses). Using the registered-device information, the computer may provide the message to the electronic device.

As noted previously, the environmental condition may be associated with operation of a legacy electronic device in the external environment. (However, in some embodiments the environmental condition is associated with operation of an electronic device that the environmental monitoring device can communicate with directly, e.g., using electrical or wireless communication.) Note that the legacy electronic device may include: a smoke detector, a carbon-monoxide detector, a dual smoke detector and carbon-monoxide detector, a burglar alarm, and/or a car alarm. Alternatively or additionally, the environmental condition may include: breaking glass, forced entry, discharge of a firearm, a scream, a cry for help, possible domestic violence, a possible criminal act, and/or a sound that is unusual or abnormal in the environment, or which may indicate an emergency situation.

Then, the electronic device may provide a user interface (operation 1112) that indicates the notification, where the user interface includes: an audio icon for playing the audio recording when the audio icon is activated, an emergency-services icon for contacting emergency services when the emergency-services icon is activated, and a false-alarm icon for indicating that the environmental condition is a false positive when the false-alarm icon is activated. For example, the message may include instructions for the user interface, or information that the electronic device or an application executing on the electronic device can use to generate and display the user interface (either or both of which are sometimes referred to as 'user-interface information'). Thus, the user interface may be specified by the computer in the message, e.g., the message may include instructions for the user interface, or the message may include information that is used by the electronic device to generate the user interface. Moreover, the message may include the audio recording or may include a link to a location (such as a hypertext link) of the audio recording (i.e., where the audio recording can be accessed when the link is activated).

Note that the user of the environmental monitoring device may or may not be different than the user of the electronic device. In particular, when the computer receives the notification, the computer may first attempt to contact or alert (i.e., to send the message to) the owner or user of the environmental monitoring device. If this is unsuccessful (e.g., a response is not received with a time interval, such as 10 seconds, 30 seconds or a minute), the computer may then attempt to contact or send messages to one or more other contacts (e.g., according to a predefined hierarchy or ranking) Alternatively, the computer may contact or send messages to one or more individuals in parallel or with a short time interval (such as 30 seconds or a minute).

If the user of the electronic device activates the audio icon, the audio recording may be played. For example, the electronic device may playback the audio recording embedded in the message, or the electronic device may access the audio recording at the location specified in the message and then may play it back to the user of the electronic device. Moreover, if the user of the electronic device activates the emergency-services icon, the electronic device may contact emergency services. In particular, a 911 dispatcher may be called and/or a Short Message Service message may be sent to the emergency services. Furthermore, if the user of the electronic device activates the false-alarm icon, the electronic device may alert the computer that the notification is a false alarm or a false positive.

In some embodiments, electronic device optionally performs one or more additional operations (1114). For example, the electronic device may receive information (which is sometimes referred to as 'user activation') about one or more icons activated by the user of electronic device (such as activation of the audio icon, the emergency-services icon and/or the false-alarm icon). Then, the electronic device may provide this information (which is sometimes referred to as 'feedback') to the computer. In response, the computer may provide an instruction to the environmental monitoring device to discontinue the notification for this environmental condition and, if the environmental monitoring device can electrically or wirelessly communicate with an activated alarm device, the environmental monitoring device may instruct the alarm device to discontinue an alarm (if the alarm is being output). The environmental monitoring device may deactivate for a time (such as a few minutes), but may provide another notification if the environmental condition or the sound is detected again, or if sensor data about the environmental condition indicates that the environmental condition is continuing or getting worse (e.g., a quantitative threat or emergency condition is occurring or becoming more severe). For example, the environmental monitoring device may provide another notification for the environmental condition if sensor data indicates the environmental condition continues and/or if other sensor data indicates that the environmental condition is not a false alarm.

Note that the computer may require one or more false-alarm responses from different contacts in the registered-device information (or a majority vote of a false alarm from multiple contacts) before concluding that the notification is a false alarm. Thus, in some embodiments at least two false-alarm responses may be required, so that the computer in essence conducts a poll to see whether the notification is a false positive. This may be useful when the computer provides messages to individuals who are not the owner or the user of the environmental monitoring device. In addition, the computer may store the feedback in a historical archive associated with the environmental monitoring device and/or the external environment. For example, the computer may provide the feedback to archive device 116 (FIG. 1), which may store the feedback in a historical log associated with the environmental monitoring device and/or the external environment.

Additionally, in some embodiments the message and the user interface include a location of the environmental condition. This location (or location information) may be relative (such as 'the smoke detector in the bedroom is going off') or absolute (such as based on triangulation, trilateration, measured sound and/or predefined acoustic characterization of the external environment, e.g., a sound delay, an echo, etc.). This may assist the user in assessing the notification and the associated environmental condition, and thus in determining how to respond to the message.

In some embodiments of method 1100, there may be additional or fewer operations. Moreover, the order of the operations may be changed, and/or two or more operations may be combined into a single operation.

In an exemplary embodiment, the computer provides one or more messages to the electronic device based on notifications received from the environmental monitoring device using push technology. A given message may include information about a notification and at least a location of an associated audio recording. Alternatively, the given message may include the audio recording. Moreover, the given message may include instructions for the user interface or the given message may include information that may be used by the electronic device to generate the user interface.

Figure 12:
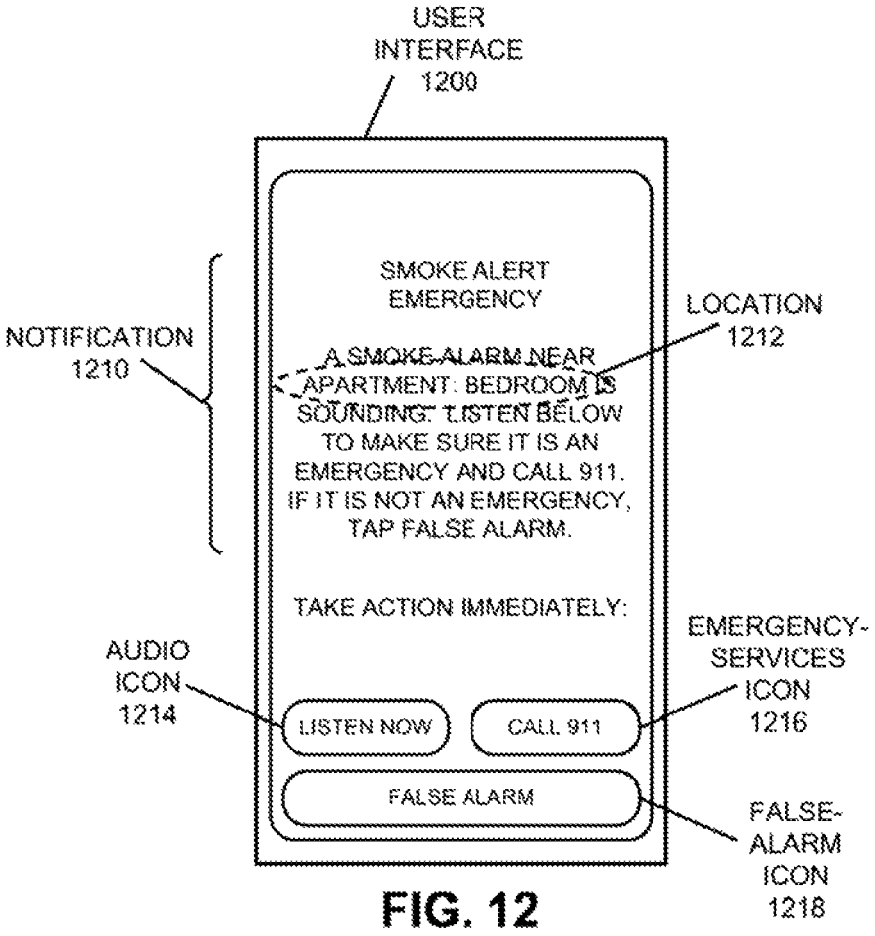
FIG. 12 is a drawing illustrating a user interface associated with the method of FIG. 11 in accordance with an embodiment of the present disclosure.

FIG. 12 presents a drawing illustrating a user interface 1200 associated with method 1100 (FIG. 11), which may be displayed on the electronic device. This user interface includes information that indicates or specifies notification 1210 about the environmental condition ('A smoke alarm near Apartment: Bedroom is sounding') and a location 1212 of the environmental condition ('near Apartment: Bedroom'). In addition, user interface 1200 includes: an audio icon 1214 for playing an audio recording of sound associated with the environmental condition when audio icon 1214 is activated, an emergency-services icon 1216 for contacting emergency services when emergency-services icon 1216 is activated, and a false-alarm icon 1218 for indicating that the environmental condition is a false positive when false-alarm icon 1218 is activated.

Figure 13:
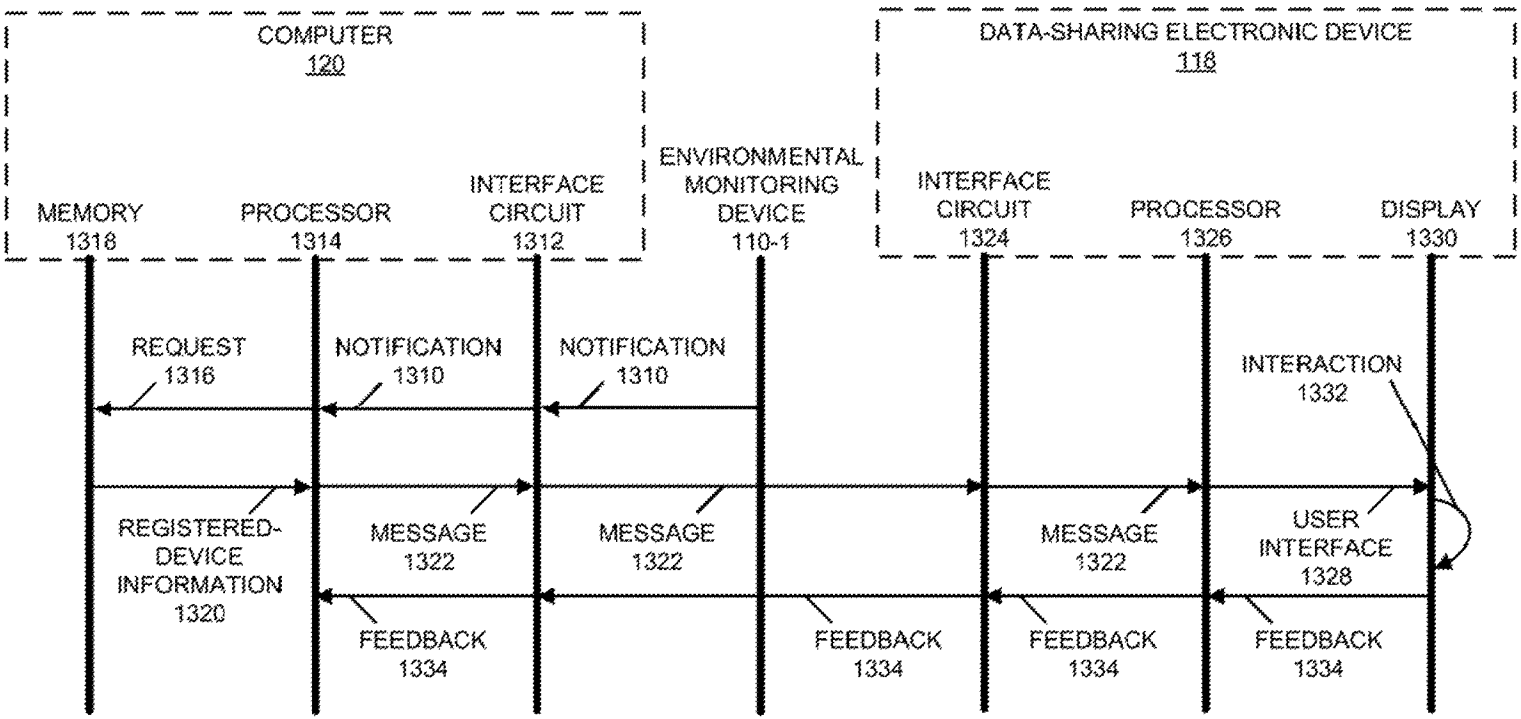
FIG. 13 is a drawing illustrating communication among at least some of the electronic devices of FIG. 1 in accordance with an embodiment of the present disclosure.

FIG. 13 presents a drawing illustrating communication among environmental monitoring device 110-1, archive device 116, data-sharing electronic device 118 and/or computer 120 in FIG. 1. In particular, environmental monitoring device 110-1 may provide notification 1310 (with an audio recording) about an environmental condition in an environment that includes environmental monitoring device 110-1. An interface circuit 1312 in computer 120 may provide notification 1310 to processor 1314. In response, processor 1314 may request 1316 and receive registered-device information 1320 from memory 1318.

Based on registered-device information 1320, processor 1314 may provide a message 1322 to interface circuit 1312, which is communicated to interface circuit 1324 in data-sharing electronic device 118. This message may include information about the notification and may include the audio recording or may specify a location of the audio recording.

Interface circuit 1324 may provide message 1322 to processor 1326. Then, processor presents user interface 1328, which is based on message 1322, on display 1330. A user of data-sharing electronic device 118 may interact 1332 with user interface 1328 to provide feedback 1334, such as by activating one or more icons in user interface 1328 (e.g., a false-alarm icon). This feedback may be provided to computer 120, which may forward it to archive device 118 (FIG. 1) for storage in a historical log associated with environmental monitoring device 110-1 and/or the environment.

Figure 14:
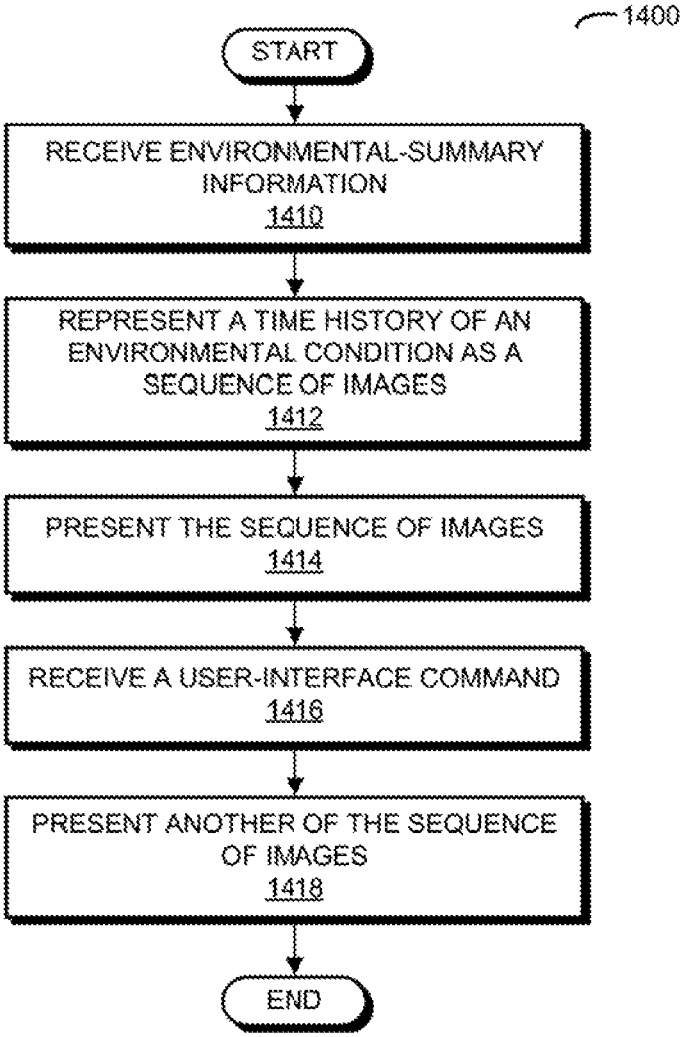
FIG. 14 is a flow diagram illustrating a method for presenting one or more images in a sequence of images associated with operation of an environmental monitoring device in FIG. 1 in accordance with an embodiment of the present disclosure.

We now further describe the presentation technique. FIG. 14 presents a flow diagram illustrating a method 1400 for presenting one or more images in a sequence of images associated with operation of an environmental monitoring device in FIG. 1, which may be performed by an electronic device (such as data-sharing electronic device 118 in FIG. 1). During operation, the electronic device receives, from the environmental monitoring device that monitors an environmental condition in an external environment that includes the environmental monitoring device, environmental-summary information (operation 1410) that specifies a time history of the environmental condition.

Then, the electronic devices represents the time history of the environmental condition as a sequence of images (operation 1412), where a given image includes a numerical value of the environmental condition at a given time and associated visual perceptual information, and the representation of the time history of the environmental condition is other than a graph of the time history of the environmental condition. For example, the representing may involve generating one or more images in the sequence of images based on the environmental-summary information. Alternatively or additionally, the representing may involve rendering one or more images in the sequence of images based on the environmental-summary information (i.e., the environmental-summary information may include the one or more images in the sequence of images).

Note that the given image may include a visual icon representing the numerical value, and the visual icon may be other than a number. Moreover, the visual perception information may include a color associated with the numerical value. In particular, variations in colors of the sequences of images may correspond to variation in the environmental condition as a function of time. For example, the variation in the colors may correspond to a direction in a color spectrum. In some embodiments, a color of the one of the sequence of images is user defined. Furthermore, the colors of the sequence of images may be associated with the environmental condition. For example, red may indicate a very elevated temperature (such as 10 C above normal), orange may indicate a moderately elevated temperature (such as 5 C above normal), gray may indicate normal temperature, light blue may indicate a moderately below-normal temperature (such as 5 C below normal) and navy blue may indicate a much below-normal temperature (such as 10 C below normal).

Next, the electronic device presents one of the sequence of images (operation 1414) on a touch-sensitive display in the electronic device. Furthermore, the electronic device receives a user-interface command (operation 1416) based on user interaction with the touch-sensitive display, and presents another of the sequence of images (operation 1418) based on the user-interface command. For example, the user-interface command may include: swiping at least a digit across a surface of the touch-sensitive display; and/or a gesture performed using at least a digit on a surface of the touch-sensitive display. (More generally, the electronic device may present one of the sequence of images on a display, which may or may not be touch sensitive. If the display is not touch sensitive, the user-interface command may be based on user interaction with a user interface, such as: a keyboard, a mouse, a stylus, a track pad, etc.)

In some embodiments of method 1400, there may be additional or fewer operations. Moreover, the order of the operations may be changed, and/or two or more operations may be combined into a single operation. While method 1400 illustrated the presentation technique with the time history of the environmental condition, in other embodiments the presentation technique is applied to an arbitrary type of data. For example, the presentation technique may be used to present one or more current environmental conditions in the external environment. Thus, instead of presenting the sequence of images, the electronic device may present one or more images, such as one image for the current temperature, another image for the current humidity, etc. Each of these images may include a numerical value and associated visual perception information (such as a color) and/or a visual icon associated with the numerical value. Furthermore, while visual perception information was used in method 1400, in other embodiments other sensor information (such as the texture or temperature of a surface) may be used in conjunction with or instead of color. For example, a liquid crystal or a magneto-rheological fluid may be used to change the texture of the surface. Similarly, one or more resistive heaters or one or more piezoelectric coolers may be used to change the temperature of the surface.

Figure 15:
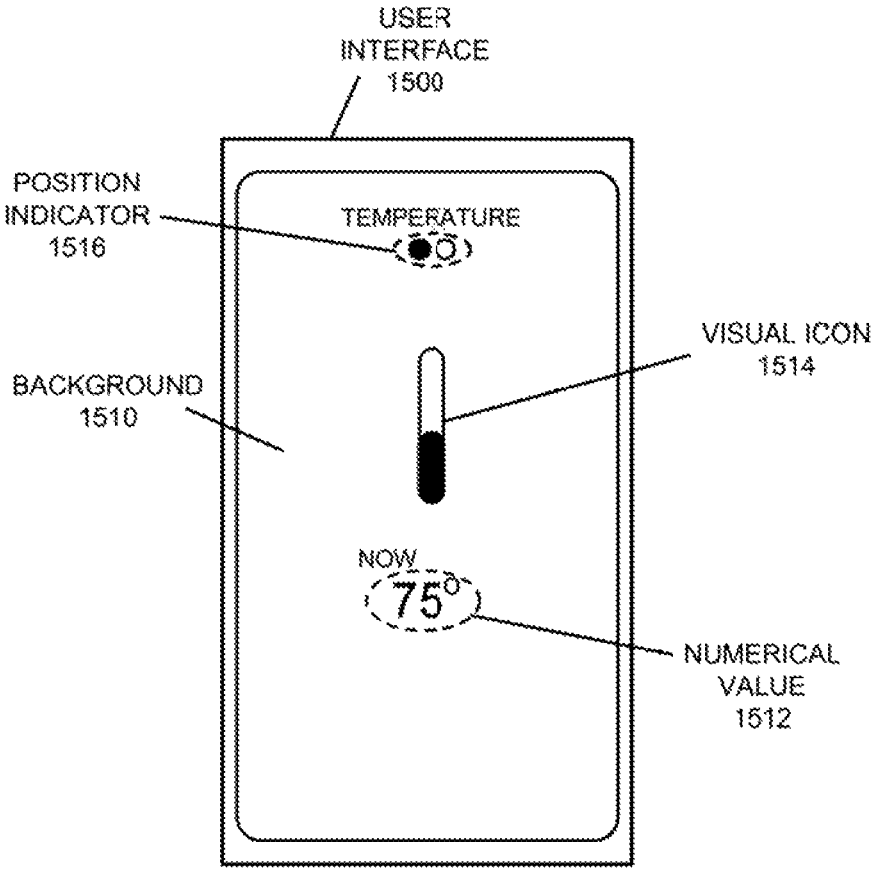
FIG. 15 is a drawing illustrating a user interface associated with the method of FIG. 14 in accordance with an embodiment of the present disclosure.

In an exemplary embodiment, instead of presenting a graph of the time history of the environmental condition, the electronic device presents a series or sequence of images that include numerical values, associated visual perception information and/or visual icons associated with the numerical values. This is shown in FIG. 15, which presents a drawing illustrating a user interface 1500. This user interface may display an image in a sequence of images associated with a time history of one or more environmental conditions in the external environment. In particular, background 1510 in user interface 1500 may be colored hues of orange. In the foreground, numerical value 1512 may indicate the temperature at a timestamp or time interval (such as an hour) associated with the image displayed in user interface 1500. In addition, visual icon 1514 may provide a graphical indication of numerical value 1512. In this case, visual icon 1514 may resemble a mercury thermometer. Note, however, that user interface 1500 does not include a traditional graph with axes. Also note that user interface 1500 includes a graphical (and non-numerical) position indicator 1516 illustrating the position of the image in the sequence of images.

Figure 16:
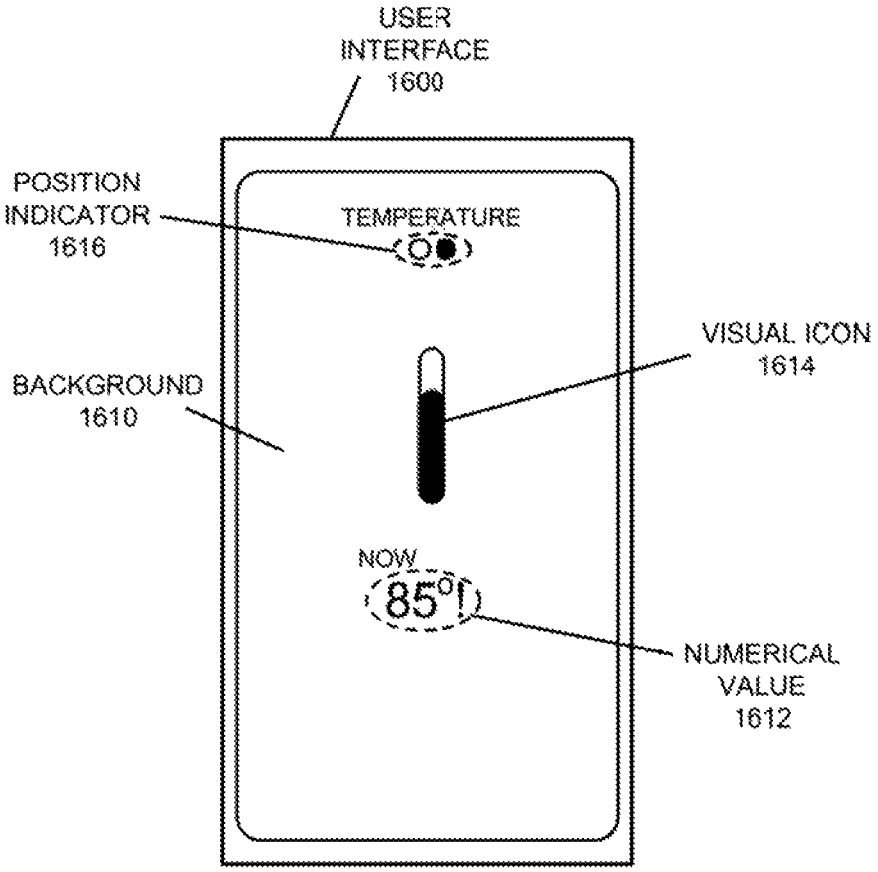
FIG. 16 is a drawing illustrating a user interface associated with the method of FIG. 14 in accordance with an embodiment of the present disclosure.

If a user of the electronic device swipes their finger over the touch-sensitive display that presents the image, another image may be displayed. This is shown in FIG. 16, which presents a drawing illustrating a user interface 1600. In this user interface, background 1610 may be colored hues of red to signify a higher temperature than in FIG. 15. In the foreground, numerical value 1612 may indicate the temperature at a timestamp or time interval associated with this other image. In addition, visual icon 1614 may provide a graphical indication of numerical value 1612. In particular, the displayed mercury level in visual icon 1614 may be higher than in visual icon 1514 (FIG. 15) to signify that the temperature increased. Note that an exclamation mark may signify a high-value of the temperature. Furthermore, graphical (and non-numerical) position indicator 1616 illustrates the position of the other image in the sequence of images.

Figure 17:
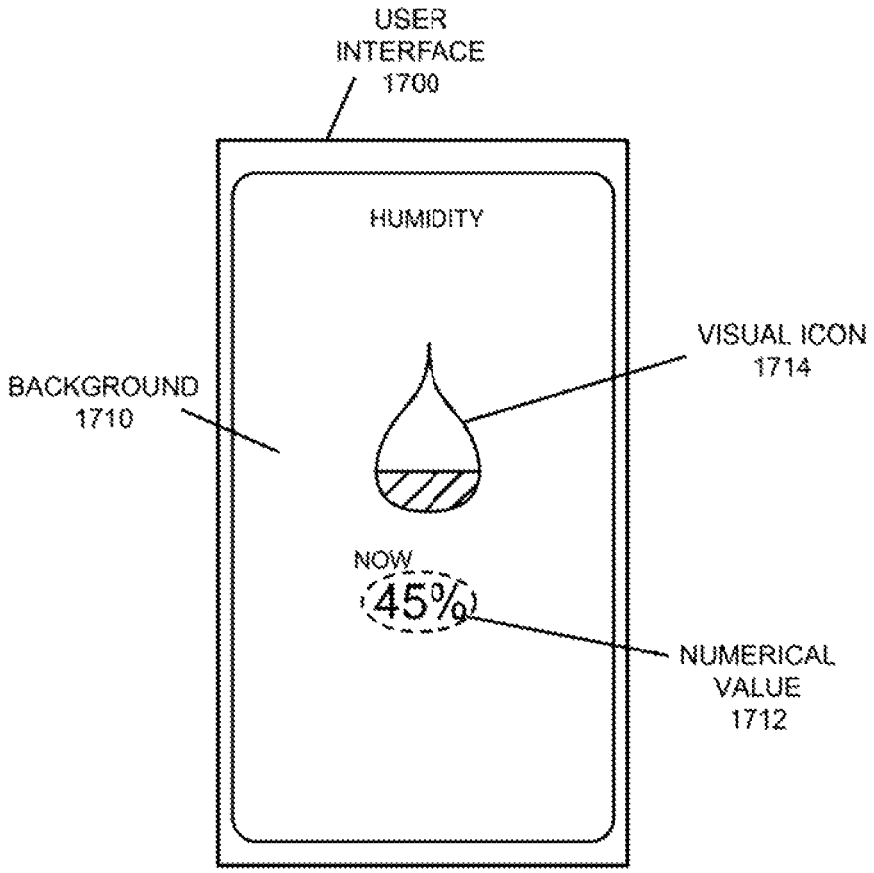
FIG. 17 is a drawing illustrating a user interface associated with the method of FIG. 14 in accordance with an embodiment of the present disclosure.

While the preceding examples illustrated the environmental condition as temperature, in another embodiment the environmental condition may include relative humidity. This is shown in FIG. 17, which presents a drawing illustrating a user interface 1700. In this user interface, background 1710 may be colored hues of gray to signify that the relative humidity is near normal or a target value. In the foreground, numerical value 1712 may indicate the relative humidity at a timestamp or time interval associated with this other image. In addition, visual icon 1714 may provide a graphical indication of numerical value 1712. In this case, visual icon 1714 resembles a drop of water with a level indicator signifying the relative humidity.

Figure 18:
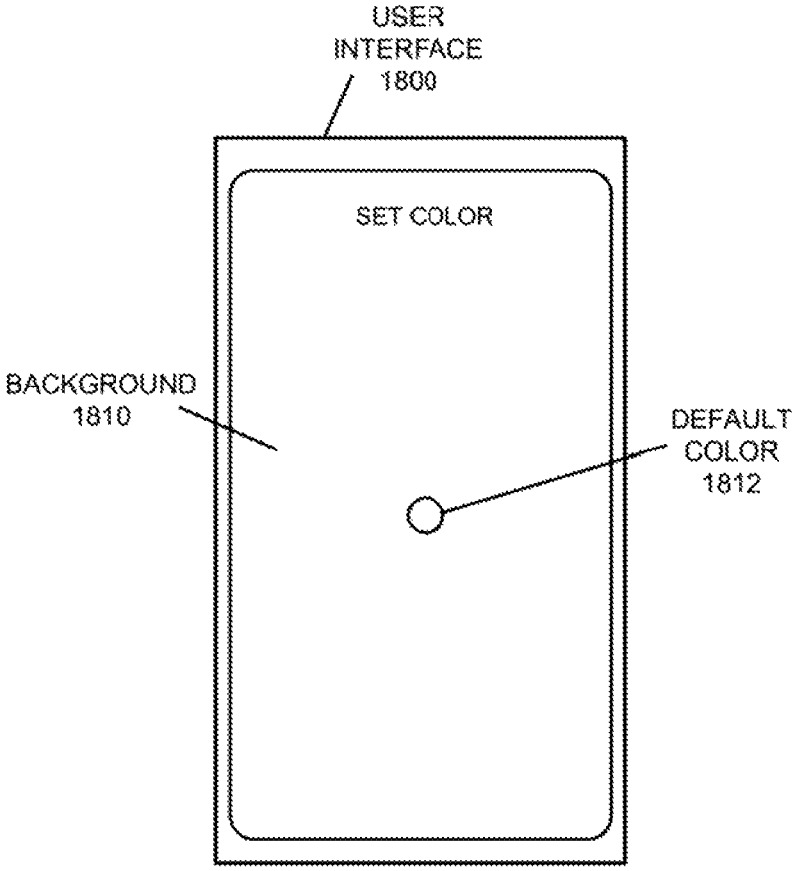
FIG. 18 is a drawing illustrating specifying a color of an image in a sequence of images in accordance with an embodiment of the present disclosure.

As noted previously, the color of a given one of the images may be associated with the numerical value and/or the environmental condition. In some embodiments, a user of electronic device may specify the color of at least one of the images, which may specify a direction in a color spectrum. This direction may define or specify the variation in the colors in the sequence of images for a given environmental condition. For example, the user may change a setting associated with a software application that executes on the electronic device, which the user uses to view the sequence of images. This is illustrated in FIG. 18, which presents a drawing illustrating a user interface 1800 that allows the user to set a color of one of the sequences of images (such as an image associated with a normal value or a target value of the environmental condition). In particular, background 1810 in user interface 1800 may represent the visible color spectrum as a continuously varying color value in a two-dimensional image. The user may position a circle to set default color 1812 value for a given one of the images. For example, the user may touch the touch-sensitive display with a finger proximate or over the circle, and may drag the circle to another position in user interface 1800. Then, the user may pull their finger away (and break contact with) the touch-sensitive display to set this value as the default color of the given one of the images.

Figure 19:
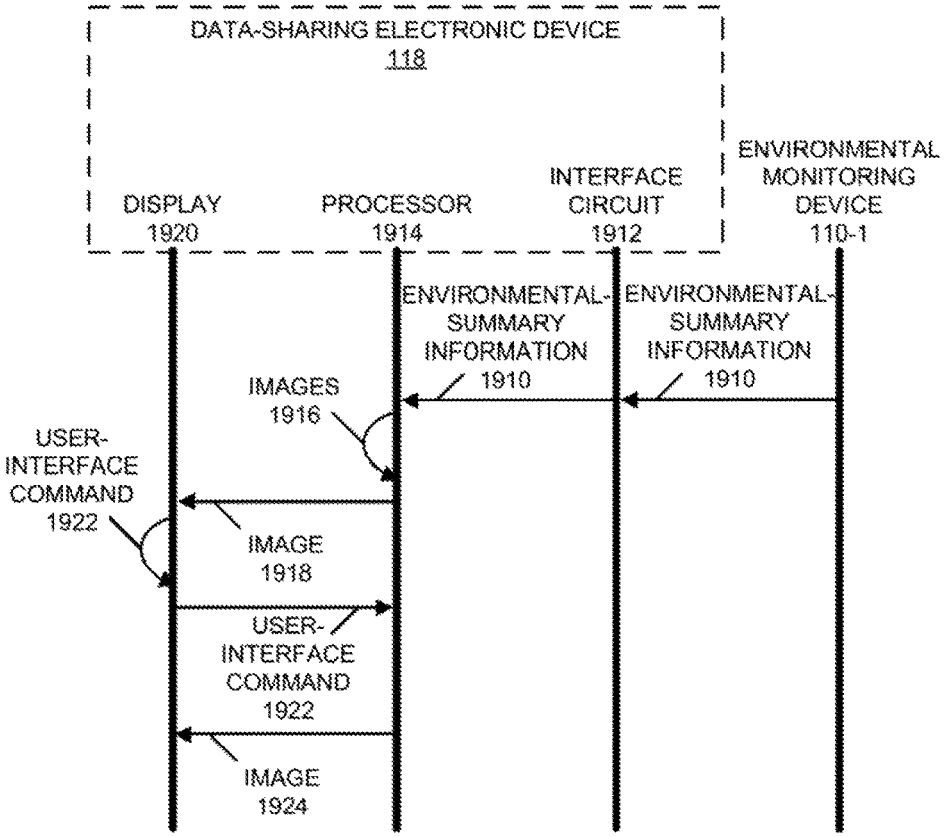
FIG. 19 is a drawing illustrating communication among at least some of the electronic devices of FIG. 1 in accordance with an embodiment of the present disclosure.

FIG. 19 presents a drawing illustrating communication among environmental monitoring device 110-1 and data-sharing electronic device 118 in FIG. 1. In particular, environmental monitoring device 110-1 may provide, to data-sharing electronic device 118, environmental-summary information 1910 that specifies a time history of the environmental condition. (Alternatively or additionally, environmental-summary information 1910 may be provided by archive device 116 and/or computer 120 in FIG. 1.) This environmental-summary information is received by interface circuit 1912 in data-sharing electronic device 118.

Interface circuit 1912 may provide environmental-summary information 1910 to processor 1914. Then, processor 1914 represents the time history of the environmental condition as a sequence of images 1916, where a given image includes a numerical value of the environmental condition at a given time and associated visual perceptual information, and the representation of the time history of the environmental condition is other than a graph of the time history of the environmental condition.

Moreover, processor 1914 provides an image 1918 in the sequence of images to display 1920, which displays image 1918. A user of data-sharing electronic device 118 may provide user-interface command 1922, e.g., by interacting with the touch-sensitive display or a user interface. In response, processor 1914 may provide another image 1924 to display 1920, which displays image 1924.

In this way, the user may 'scroll' through the time history of the environmental condition, and may intuitively understand the progression of the environmental condition as a function of time without view a traditional graph.

We now describe embodiments of an electronic device. FIG. 20 presents a block diagram illustrating an electronic device 2000, such as one of environmental monitoring devices 110, archive device 116, data-sharing electronic device 118, computer 120 and/or optionally some of optional electronic devices 114 (such as optional electronic device 114-2) in FIG. 1. (In the discussion that follows, the functionality of one of environmental monitoring devices 110 is used as an illustration. Other electronic devices, such as data-sharing electronic device 118 and/or computer 120, may have a subset of this functionality.) This electronic device includes processing subsystem 2010 (and, more generally, an integrated circuit or a control mechanism), memory subsystem 2012, networking subsystem 2014, power subsystem 2016, switching subsystem 2020 and optional sensor subsystem 2024 (i.e., a data-collection subsystem and, more generally, a sensor mechanism). Processing subsystem 2010 includes one or more devices configured to perform computational operations (such as executing techniques to process sensor data). For example, processing subsystem 2010 can include one or more microprocessors, application-specific integrated circuits (ASICs), microcontrollers, programmable-logic devices, and/or one or more digital signal processors (DSPs).

Memory subsystem 2012 includes one or more devices for storing data and/or instructions for processing subsystem 2010, networking subsystem 2014 and/or optional sensor subsystem 2024. For example, memory subsystem 2012 can include dynamic random access memory (DRAM), static random access memory (SRAM), and/or other types of memory. In some embodiments, instructions for processing subsystem 2010 in memory subsystem 2012 include: one or more program modules or sets of instructions (such as one or more program modules 2032), which may be executed in an operating environment (such as operating system 2034) by processing subsystem 2010. While the one or more program modules 2032 executed by processing subsystem 2010 may be resident on electronic device 2000 (such as stand-alone applications or portions of one or more other applications that are resident on and which execute on electronic device 2000), in some embodiments a given one of the one or more program modules 2032 may be embedded in a web page that is provided by a remote server or computer via a network, and which is rendered by a web browser on electronic device 2000. For example, at least a portion of the given program module may be an application tool that is embedded in the web page, and which executes in a virtual environment of the web browser. Thus, the application tool may be provided to electronic device 2000 via a client-server architecture. Note that the one or more computer programs may constitute a computer-program mechanism. Moreover, instructions in the various modules in memory subsystem 2012 may be implemented in: a high-level procedural language, an object-oriented programming language, and/or in an assembly or machine language. Furthermore, the programming language may be compiled or interpreted, e.g., configurable or configured (which may be used interchangeably in this discussion), to be executed by processing subsystem 2010.

In addition, memory subsystem 2012 can include mechanisms for controlling access to the memory. In some embodiments, memory subsystem 2012 includes a memory hierarchy that comprises one or more caches coupled to a memory in electronic device 2000. In some of these embodiments, one or more of the caches is located in processing subsystem 2010.

In some embodiments, memory subsystem 2012 is coupled to one or more high-capacity mass-storage devices (not shown). For example, memory subsystem 2012 can be coupled to a magnetic or optical drive, a solid-state drive, or another type of mass-storage device. In these embodiments, memory subsystem 2012 can be used by electronic device 2000 as fast-access storage for often-used data, while the mass-storage device is used to store less frequently used data.

Networking subsystem 2014 includes one or more devices configured to couple to and communicate on a wired and/or wireless network (i.e., to perform network operations and, more generally, communication), including: interface circuit 2028 and one or more associated antennas 2030. (While FIG. 20 includes one or more antennas 2030, in some embodiments electronic device 2000 includes one or more nodes on interface circuit 2028, e.g., pads, which can be coupled to one or more antennas 2030. Thus, electronic device 2000 may or may not include one or more antennas 2030.) For example, networking subsystem 2014 can include: a ZigBee® networking subsystem, a Bluetooth networking system (such as Bluetooth Low Energy), a cellular networking system (e.g., a 3G/4G network such as UMTS, LTE, etc.), a universal serial bus (USB) networking system, a networking system based on the standards described in IEEE 802.11 (e.g., a Wi-Fi networking system), an Ethernet networking system, an infra-red communication system, a power-line communication system and/or another communication system (such as a near-field-communication system or an ad-hoc-network networking system). Note that the combination of interface circuit 2028 and at least one of one or more antennas 2030 may constitute a radio.

Moreover, networking subsystem 2014 includes processors, controllers, radios/antennas, sockets/plugs, and/or other devices used for coupling to, communicating on, and handling data and events for each supported networking system. Note that mechanisms used for coupling to, communicating on, and handling data and events on the network for each network system are sometimes collectively referred to as a 'network interface' for the network system. In some embodiments, a 'network' between the electronic devices does not yet exist. Therefore, electronic device 2000 may use the mechanisms in networking subsystem 2014 for performing simple wireless communication between the electronic devices, e.g., transmitting advertising or beacon frames and/or scanning for advertising frames transmitted by other electronic devices.

Furthermore, electronic device 2000 may include power subsystem 2016 with one or more power sources 2018. Each of these power sources may include: a battery (such as a rechargeable or a non-rechargeable battery), a DC power supply, a transformer, and/or a switched-mode power supply. Moreover, the one or more power sources 2018 may operate in a voltage-limited mode or a current-limited mode.

Furthermore, these power sources may be mechanically and electrically coupled by a male or female adaptor to: a wall or electrical-outlet socket or plug (such as a two or three-pronged electrical-outlet plug, which may be collapsible or retractable), a light socket (or light-bulb socket), electrical wiring (such as a multi-wire electrical terminal), a generator, a USB port or connector, a DC-power plug or socket, a cellular-telephone charger cable, a photodiode, a photovoltaic cell, etc. This mechanical and electrical coupling may be rigid or may be remateable. Note that the one or more power sources 2018 may be mechanically and electrically coupled to an external power source or another electronic device by one of the electrical-connection nodes in switch 2022 in switching subsystem 2020.

In some embodiments, power subsystem 2016 includes or functions as a pass-through power supply for one or more electrical connectors to an external electronic device (such as an appliance or a regulator device) that can be plugged into the one or more electrical connectors. Power to the one or more electrical connectors (and, thus, the external electronic device) may be controlled locally by processing subsystem 2010, switching subsystem 2020 (such as by switch 2022), and/or remotely via networking subsystem 2014.

Furthermore, optional sensor subsystem 2024 may include one or more sensor devices 2026 (or a sensor array), which may include one or more processors and memory. For example, the one or more sensor devices 2026 may include: a thermal sensor (such as a thermometer), a humidity sensor, a barometer, a camera or video recorder (such as a CCD or CMOS imaging sensor), one or more microphones (which may be able to record acoustic information, including acoustic information in an audio band of frequencies, in mono or stereo), a load-monitoring sensor or an electrical-characteristic detector (and, more generally, a sensor that monitors one or more electrical characteristics), an infrared sensor (which may be active or passive), a microscope, a particle detector (such as a detector of dander, pollen, dust, exhaust, etc.), an air-quality sensor, a particle sensor, an optical particle sensor, an ionization particle sensor, a smoke detector (such as an optical smoke detector or an ionizing smoke detector), a fire-detection sensor, a radon detector, a carbon-monoxide detector, a chemical sensor or detector, a volatile-organic-compound sensor, a combustible gas sensor, a chemical-analysis device, a mass spectrometer, a micro-analysis device, a nano-plasmonic sensor, a genetic sensor (such as a micro-array), an accelerometer, a position or a location sensor (such as a location sensor based on the Global Positioning System or GPS), a gyroscope, a motion sensor (such as a light-beam sensor), a contact sensor, a strain sensor (such as a strain gauge), a proximity sensor, a microwave/radar sensor (which may be active or passive), an ultrasound sensor, a vibration sensor, a fluid flow sensor, a photo-detector, a Geiger counter, a radio-frequency radiation detector, and/or another device that measures a physical effect or that characterizes an environmental factor or physical phenomenon (either directly or indirectly). Note that the one or more sensor devices 2026 may include redundancy (such as multiple instances of a type of sensor device) to address sensor failure or erroneous readings, to provide improved accuracy and/or to provide improved precision.

During operation of electronic device 2000, processing subsystem 2010 may execute one or more program modules 2032, such as an environmental-monitoring application that uses one or more sensor devices 2026 to monitor one or more environmental conditions in an environment that includes electronic device 2000. The resulting sensor data may be used by the environmental-monitoring application to modify operation of electronic device 2000 and/or the external electronic device, and/or to provide information about the environment to a user of another (separate) electronic device (e.g., via networking subsystem 2014). Furthermore, in embodiments where electronic device 2000 is data-sharing electronic device 118 (FIG. 1), one or more program modules 2032 may include a notification application that performs the communication technique and/or a presentation application that performs the presentation technique. Alternatively, in embodiments where electronic device 2000 is computer 120 (FIG. 1), one or more program modules 2032 may include a calibration application that performs the calibration technique.

Within electronic device 2000, processing subsystem 2010, memory subsystem 2012, and networking subsystem 2014, power subsystem 2016, switching subsystem 2020 and/or optional sensor subsystem 2024 may be coupled using one or more interconnects, such as bus 2036. These interconnects may include an electrical, optical, and/or electro-optical connection that the subsystems can use to communicate commands and data among one another. Although only one bus 2036 is shown for clarity, different embodiments can include a different number or configuration of electrical, optical, and/or electro-optical connections among the subsystems.

Electronic device 2000 can be (or can be included in) a wide variety of electronic devices, such as an electronic device with at least one network interface. For example, electronic device 2000 can be (or can be included in): a sensor (such as a smart sensor), a tablet computer, a smartphone, a cellular telephone, an appliance, a regulator device, a consumer-electronic device (such as a baby monitor), a portable computing device, an access point, a router, a switch, communication equipment, test equipment, a digital signal processor, a controller, a personal digital assistant, a laser printer (or other office equipment such as a photocopier), a personal organizer, a toy, a set-top box, a computing device (such as a laptop computer, a desktop computer, a server, and/or a subnotebook/netbook), a light (such as a nightlight), a space heater, an alarm, a smoke detector, a carbon-monoxide detector, an environmental monitoring device (which monitors an environmental condition in the environment that includes electronic device 2000), and/or another electronic device.

Although specific components are used to describe electronic device 2000, in alternative embodiments, different components and/or subsystems may be present in electronic device 2000. For example, electronic device 2000 may include one or more additional processing subsystems, memory subsystems, networking subsystems, power subsystems, switching subsystems, and/or sensor subsystems. Moreover, one or more of the subsystems may not be present in electronic device 2000. Furthermore, in some embodiments, electronic device 2000 may include one or more additional subsystems that are not shown in FIG. 20 such as a user-interface subsystem, a display subsystem, and/or a feedback subsystem (which may include speakers and/or an optical source).

Figure 20:
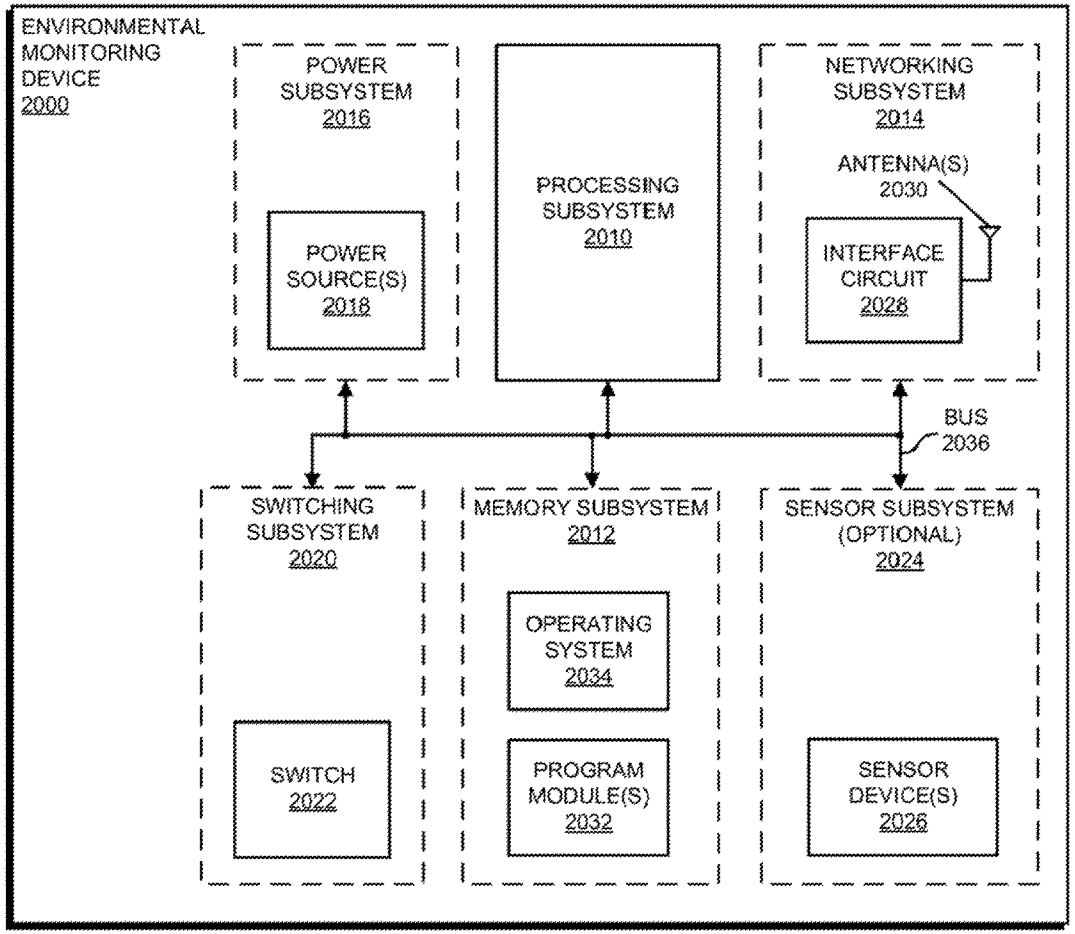
FIG. 20 is a block diagram illustrating an electronic device in FIG. 1 in accordance with an embodiment of the present disclosure.

Although separate subsystems are shown in FIG. 20, in some embodiments, some or all of a given subsystem or component can be integrated into one or more of the other subsystems or component(s) in electronic device 2000. For example, in some embodiments program module 2022 is included in operating system 2034. In some embodiments, a component in a given subsystem is included in a different subsystem.

Moreover, the circuits and components in electronic device 2000 may be implemented using any combination of analog and/or digital circuitry, including: bipolar, PMOS and/or NMOS gates or transistors. Furthermore, signals in these embodiments may include digital signals that have approximately discrete values and/or analog signals that have continuous values. Additionally, components and circuits may be single-ended or differential, and power supplies may be unipolar or bipolar.

An integrated circuit may implement some or all of the functionality of networking subsystem 2014, such as one or more radios. Moreover, the integrated circuit may include hardware and/or software mechanisms that are used for transmitting wireless signals from electronic device 2000 and receiving signals at electronic device 2000 from other electronic devices. Aside from the mechanisms herein described, radios are generally known in the art and hence are not described in detail. In general, networking subsystem 2014 and/or the integrated circuit can include any number of radios. Note that the radios in multiple-radio embodiments function in a similar way to the radios described in single-radio embodiments.

In some embodiments, networking subsystem 2014 and/or the integrated circuit include a configuration mechanism (such as one or more hardware and/or software mechanisms) that configures the radios to transmit and/or receive on a given channel (e.g., at a given carrier frequency). For example, in some embodiments, the configuration mechanism can be used to switch the radio from monitoring and/or transmitting on a given channel to monitoring and/or transmitting on a different channel. (Note that 'monitoring' as used herein comprises receiving signals from other electronic devices and possibly performing one or more processing operations on the received signals, e.g., determining if the received signal comprises an advertising frame, calculating a performance metric, etc.)

The described embodiments of the calibration technique, the communication technique and the presentation technique may be used in a variety of network interfaces. Furthermore, while some of the operations in the preceding embodiments were implemented in hardware or software, in general the operations in the preceding embodiments can be implemented in a wide variety of configurations and architectures. Therefore, some or all of the operations in the preceding embodiments may be performed in hardware, in software or both. For example, at least some of the operations in the calibration technique, the communication technique and/or the presentation technique may be implemented using program module 2022, operating system 2034 (such as drivers for interface circuit 2028) and/or in firmware in interface circuit 2028. Alternatively or additionally, at least some of the operations in the calibration technique, the communication technique and/or the presentation technique may be implemented in a physical layer, such as hardware in interface circuit 2028.

Note that the functions of electronic device 2000 may be distributed over a large number of servers or computers, with various groups of the servers or computers performing particular subsets of the functions. These servers or computers may be at one or more locations. Thus, in some embodiments electronic device 2000 includes a computer system.

In the preceding description, we refer to 'some embodiments.' Note that 'some embodiments' describes a subset of all of the possible embodiments, but does not always specify the same subset of embodiments.

The foregoing description is intended to enable any person skilled in the art to make and use the disclosure, and is provided in the context of a particular application and its requirements. Moreover, the foregoing descriptions of embodiments of the present disclosure have been presented for purposes of illustration and description only. They are not intended to be exhaustive or to limit the present disclosure to the forms disclosed. Accordingly, many modifications and variations will be apparent to practitioners skilled in the art, and the general principles defined herein may be applied to other embodiments and applications without departing from the spirit and scope of the present disclosure. Additionally, the discussion of the preceding embodiments is not intended to limit the present disclosure. Thus, the present disclosure is not intended to be limited to the embodiments shown, but is to be accorded the widest scope consistent with the principles and features disclosed herein.

What is claimed is:

1. A system for calibrating an environmental monitoring device, the system comprising:

a computer, comprising:

an interface circuit configured to communicate with the environmental monitoring device and an electronic device associated with a user of the environmental monitoring device;

a processor coupled to the interface circuit, wherein, during operation of the computer, the processor is configured to execute a program module; and memory, coupled to the processor, configured to store the program module, wherein the program module includes instructions for:

providing, to the electronic device, user-interface information associated with a user interface that allows the user to select a legacy device to monitor in an environment that includes the environmental monitoring device, wherein the legacy device includes one of: a smoke detector, a carbon-monoxide detector, a dual smoke detector and carbon-monoxide detector, a burglar alarm, a car alarm, and another type of alarm device;

receiving, from the electronic device, a user selection in the user interface to monitor sound corresponding to an alarm output by the legacy device when the legacy device is activated;

providing, to the electronic device, an instruction to activate the legacy device;

receiving, from the environmental monitoring device, legacy-device information specifying whether the legacy device was detected and a type of legacy device identified based on the monitored sound; and providing, to the electronic device, remedial-action instructions when the legacy-device information indicates that the activated legacy device was not detected, wherein the remedial-action instructions comprise one or more of: an instruction to repeat the activation of the legacy device, an instruction to move the environmental monitoring device, and an instruction to move the legacy device in the environment.

2. The system of claim 1, wherein the program module is executed when the user calibrates the environmental monitoring device.

3. The system of claim 1, wherein the legacy-device information includes one of: a location of the legacy device and an acoustic characteristic of the environment.

4. The system of claim 1, wherein the program module includes instructions for:

providing, to the electronic device, second user-interface information associated with a second user interface that allows the user to select another legacy device to monitor;

receiving, from the electronic device, a second user selection in the second user interface to monitor sound corresponding to an alarm output by a second legacy device in the environment when the second legacy device is activated, wherein the second legacy device includes an instance of one of: the smoke detector, the carbon-monoxide detector, the dual smoke detector and carbon-monoxide detector, the burglar alarm, the car alarm, and the other type of alarm device;

providing, to the electronic device, an instruction to activate the second legacy device; and receiving, from the environmental monitoring device, second legacy-device information specifying whether the second legacy device was detected and the type of second legacy device identified based on the monitored sound.

5. The system of claim 1, wherein the program module includes instructions for providing, to the electronic device, second user-interface information associated with a second user interface that allows the user to select another legacy device to monitor and to specify one or more contacts to notify when the legacy device is activated.

6. The system of claim 5, wherein the program module further includes instructions for:

receiving, from the electronic device, a second user selection in the second user interface to specify the one or more contacts; and providing, to the electronic device, third user-interface information associated with a third user interface that allows the user to provide the one or more contacts and associated contact information.

7. The system of claim 1, wherein the program module further includes instructions for:

receiving, from the electronic device, a second user selection in the user interface to remind the user later to monitor the sound corresponding to the alarm output by the legacy device when the legacy device is activated; and after a predefined time interval, providing, to the electronic device, a reminder asking the user whether they want to monitor the sound corresponding to the alarm output by the legacy device when the legacy device is activated.

8. The system of claim 1, wherein the type of legacy device is indeterminate; and wherein the program module further includes instructions for:

providing, to the electronic device, a request for the user to specify whether the legacy device is one of: the smoke detector, the carbon-monoxide detector, the dual smoke detector and carbon-monoxide detector, the burglar alarm, the car alarm, and the other type of alarm device; and receiving, from the electronic device, a response to the request specifying the type of the legacy device.

9. The system of claim 1, wherein the program module further includes instructions for repeating the providing of the user-interface information, the receiving of the user selection, the providing of the instruction, and the receiving of the legacy-device information after one of: a time interval, when an object in the environment is repositioned, and when a wireless network that includes the environmental monitoring device is modified.

10. A computer-program product for use in conjunction with a computer, the computer-program product comprising a non-transitory computer-readable storage medium and a computer-program mechanism embedded therein to calibrate an environmental monitoring device, the computer-program mechanism including:

instructions for providing, to an electronic device associated with a user of the environmental monitoring device, user-interface information associated with a user interface that allows the user to select to monitor sound corresponding to an alarm output by a legacy device that is in an environment that includes the environmental monitoring device, wherein the legacy device includes one of: a smoke detector, a carbon-monoxide detector, a dual smoke detector and carbon-monoxide detector, a burglar alarm, a car alarm, and another type of alarm device;

instructions for receiving, from the electronic device, a user selection in the user interface to monitor sound corresponding to an alarm output by the legacy device when the legacy device is activated;

instructions for providing, to the electronic device, an instruction to activate the legacy device;

instructions for receiving, from the environmental monitoring device, legacy-device information specifying whether the legacy device was detected and a type of legacy device identified based on the monitored sound; and instructions for providing, to the electronic device, remedial-action instructions when the legacy-device information indicates that the activated legacy device was not detected, wherein the remedial-action instructions comprise one or more of: an instruction to repeat the activation of the legacy device, an instruction to move the environmental monitoring device, and an instruction to move the legacy device in the environment.

11. The computer-program product of claim 10, wherein the computer-program mechanism further includes instructions for:

providing, to the electronic device, second user-interface information associated with a second user interface that allows the user to select another legacy device to monitor;

receiving, from the electronic device, a second user selection in the second user interface to monitor sound corresponding to an alarm output by a second legacy device in the environment when the second legacy device is activated, wherein the second legacy device includes an instance of one of: the smoke detector, the carbon-monoxide detector, the dual smoke detector and carbon-monoxide detector, the burglar alarm, the car alarm, and the other type of alarm device;

providing, to the electronic device, an instruction to activate the second legacy device; and receiving, from the environmental monitoring device, second legacy-device information specifying whether the second legacy device was detected and the type of second legacy device identified based on the monitored sound.

12. The computer-program product of claim 10, wherein the computer-program mechanism further includes instructions for providing, to the electronic device, second user-interface information associated with a second user interface that allows the user to select another legacy device to monitor and to specify one or more contacts to notify when the legacy device is activated.

13. The computer-program product of claim 12, wherein the computer-program mechanism further includes instructions for:

receiving, from the electronic device, a second user selection in the second user interface to specify the one or more contacts; and providing, to the electronic device, third user-interface information associated with a third user interface that allows the user to provide the one or more contacts and associated contact information.

14. The computer-program product of claim 10, wherein the computer-program mechanism further includes instructions for:

receiving, from the electronic device, a second user selection in the user interface to remind the user later to monitor the sound corresponding to the alarm output by the legacy device when the legacy device is activated; and after a predefined time interval, providing, to the electronic device, a reminder asking the user whether they want to monitor the sound corresponding to the alarm output by the legacy device when the legacy device is activated.

15. The computer-program product of claim 10, wherein the type of legacy device is indeterminate; and wherein the computer-program mechanism further includes instructions for:

providing, to the electronic device, a request for the user to specify whether the legacy device is one of: the smoke detector, the carbon-monoxide detector, the dual smoke detector and carbon-monoxide detector, the burglar alarm, the car alarm, and the other type of alarm device; and receiving, from the electronic device, a response to the request specifying the type of the legacy device.

16. The computer-program product of claim 10, wherein the computer-program mechanism further includes instructions for repeating the receiving of the user selection, the providing of the user-interface information, the providing of the instruction, and the receiving of the legacy-device information after one of: a time interval, when an object in the environment is repositioned, and when a wireless network that includes the environmental monitoring device is modified.

17. A computer-implemented method for calibrating an environmental monitoring device, wherein the method performed by a control mechanism in the computer comprises:

providing, to an electronic device associated with a user of the environmental monitoring device, user-interface information associated with a user interface that allows the user to select to monitor sound corresponding to an alarm output by a legacy device that is in an environment that includes the environmental monitoring device, wherein the legacy device includes one of: a smoke detector, a carbon-monoxide detector, a dual smoke detector and carbon-monoxide detector, a burglar alarm, a car alarm, and another type of alarm device;

receiving, from the electronic device, a user selection in the user interface to monitor sound corresponding to the alarm output by the legacy device when the legacy device is activated;

providing, to the electronic device, an instruction to activate the legacy device;

receiving, from the environmental monitoring device, legacy-device information specifying whether the legacy device was detected and a type of legacy device identified based on the monitored sound; and providing, to the electronic device, remedial-action instructions when the legacy- device information indicates that the activated legacy device was not detected, wherein the remedial-action instructions comprise one or more of: an instruction to repeat the activation of the legacy device, an instruction to move the environmental monitoring device, and an instruction to move the legacy device in the environment.

18. The method of claim 17, wherein the type of legacy device is indeterminate; and wherein the method further includes:

providing, to the electronic device, a request for the user to specify whether the legacy device is one of: the smoke detector, the carbon-monoxide detector, the dual smoke detector and carbon-monoxide detector, the burglar alarm, the car alarm, and the other type of alarm device; and receiving, from the electronic device, a response to the request specifying the type of the legacy device.

* * * * *